US009370251B2

(12) United States Patent
Ead

(10) Patent No.: US 9,370,251 B2
(45) Date of Patent: Jun. 21, 2016

(54) HOSPITAL BED FOR AUTOMATICALLY CHANGING SHEETS

(71) Applicant: Ultimate Comfort n Care Products LLC, Providence, RI (US)

(72) Inventor: Nimer Mohammed Ead, Providence, RI (US)

(73) Assignee: Ultimate Comfort N Care Products LLC, Providence, RI (US)

( * ) Notice: Subject to any disclaimer, the term of this patent is extended or adjusted under 35 U.S.C. 154(b) by 292 days.

(21) Appl. No.: 14/214,098

(22) Filed: Mar. 14, 2014

(65) Prior Publication Data

US 2014/0259406 A1 Sep. 18, 2014

Related U.S. Application Data

(60) Provisional application No. 61/784,948, filed on Mar. 14, 2013.

(51) Int. Cl.

| | |
|---|---|
| ***A47C 21/02*** | (2006.01) |
| ***A61G 7/057*** | (2006.01) |
| ***A61G 7/05*** | (2006.01) |
| ***A47C 27/08*** | (2006.01) |

(52) U.S. Cl.

CPC ..... *A47C 21/028* (2013.01); *A47C 27/083* (2013.01); *A61G 7/0502* (2013.01); *A61G 7/057* (2013.01); *A61G 7/0573* (2013.01); *A61G 7/05769* (2013.01)

(58) Field of Classification Search

CPC .. A47C 21/028; A47C 27/083; A61G 7/0573; A61G 7/057; A61G 7/05769; A61G 7/0502

See application file for complete search history.

(56) References Cited

U.S. PATENT DOCUMENTS

| | | | | |
|---|---|---|---|---|
| 6,006,378 | A | 12/1999 | Hayashi | |
| 6,594,837 | B2 | 7/2003 | Khait | |
| 7,191,479 | B1 * | 3/2007 | Cheng | A47C 21/028 5/488 |
| 7,895,688 | B1 * | 3/2011 | Rowes | A61G 7/001 5/607 |
| 8,719,980 | B2 * | 5/2014 | Chen | A61G 7/0573 297/311 |
| 2011/0072582 | A1 * | 3/2011 | Patterson | A61F 13/15 5/484 |
| 2011/0214233 | A1 * | 9/2011 | Stang | A47C 21/028 5/488 |
| 2012/0159709 | A1 * | 6/2012 | Nguyen | A47C 21/028 5/488 |
| 2013/0291309 | A1 * | 11/2013 | Koorey | A47C 19/045 5/658 |

* cited by examiner

*Primary Examiner* — David E Sosnowski

(74) *Attorney, Agent, or Firm* — Knobbe, Martens, Olson & Bear LLP

(57) ABSTRACT

The present invention relates generally to an ultimate comfort n care bed, and a bed apparatus capable of seamlessly changing bed sheets while being occupied by a person, a method of relieving ulcers, and a method thereof. The present invention also relates to a medical or a hospital bed, and, more particularly, to a hospital bed capable of seamlessly changing bedsheets while the hospital bed is occupied by a patient. The present invention also comprises of a medical bed apparatus which allows the seamlessly changing of a used bed sheet with a new bed sheet while the bed is occupied by a person, and a method thereof.

12 Claims, 15 Drawing Sheets

HOSPITAL BED FOR AUTOMATICALLY CHANGING SHEETS

CROSS-REFERENCE TO RELATED APPLICATION

The instant patent application claims priority to and the benefit of pending U.S. Provisional Patent Application Ser. No. 61/784,948, filed on Mar. 14, 2013, titled "MALIX BED, AND A BED APPARATUS CAPABLE OF SEAMLESSLY CHANGING BED-SHEETS WHILE OCCUPIED BY AN IMMOBILE PERSON, AND A METHOD THEREOF", the entire disclosure of which provisional application is incorporated herein by reference.

FIELD OF THE INVENTION

The present invention relates generally to an ultimate comfort n care bed, and a bed apparatus capable of seamlessly changing bed sheets while being occupied by a person, a method of relieving ulcers, and a method thereof. The present invention also relates to a medical or a hospital bed, and, more particularly, to a hospital bed capable of seamlessly changing bed-sheets while the hospital bed is occupied by a patient. The present invention also comprises of a medical bed apparatus which allows the seamlessly changing of a used bed sheet with a new bed sheet while the bed is occupied by a person, and a method thereof.

BACKGROUND INFORMATION

Hospital beds have been known and have been used for many years, and under a variety of applications.

Existing hospital beds, including various kinds of hospital beds, the patient must be moved before changing bed sheets. In many cases the disabled or some patients cannot leave the bed without the help of others. This is a hardship for patient family members and the nurses, and more importantly, it may cause pain and discomfort to the patients. For those who are injured in the cervical vertebra or the vertebra, suffering from various kinds of serious injuries, or a patient recovering from a surgery, it often causes secondary injury if the patient is moved, and this also further hinders patient recovery.

Changing bed linens in a hospital or healthcare facility is necessary and advantageous. It allows the hospital staff and patients to promote cleanliness and prevents unnecessary infections, ulcers, injuries, or losing expensive hard-to-replace items. Changing the bed linen while the patient is still on the hospital bed carries significant challenges, both for the patient, and the caregiver. Multiple steps need to be taken to make the task possible. However, these steps are not without drawbacks and limitations, for example:

(1) Making arrangements for assistance: Assistance is required whether one is at a hospital, a skilled nursing facility, or at home. If one is at the home, then one would need a friend or a family member who would be willing to help out;

(2) Scheduling helpers: Learning how to provide the care needed without straining ones back or otherwise injuring oneself is not only important but it is very challenging too;

(3) Positioning the bed: The quality of the bed and adjustability are very crucial, trying to work with a non-adjustable medical bed is not practical, as it will make bedside care extremely difficult. Further it requires more people and this creates a crowded area around the bed, which restricts maneuverability, such as, having two to four people doing the task;

(4) Raising and lowering the ends of the bed: For example, when patients have congestive heart failure or respiratory disease, a hospital bed's ability to raise the head of the bed up will greatly help the patient to breathe more easily, moving the patient out of the bed or rolling him on either side or lifting him up;

(5) Side rails and safety: Side rails and safety are extremely important to have if the patient is confused or may become confused in the future, and this also prevents a patient from falling out of the medical bed;

(6) Keeping linens flat and smooth: Wrinkles in the bed, or the bed sheet, or any debris will irritate the skin and cause discomfort as well as injury to the skin. Some patients become so sensitive that they cannot tolerate anything at all lying on top of their feet, even a bed sheet;

(7) Need to reposition patient up in bed: If assistance is not provided, the patient remains slumped down too far toward the foot of the bed and will not only feel uncomfortable, but the position can interfere with ease in breathing and also cause unnecessary pressure on the base of the spline and result in skin breakdown;

(8) Need to avoid dragging: When a patient experiences difficulty turning him or pulling him up in bed, pulling or pushing him without lifting will result in dragging his body across the bed. Dragging him from side to side or up in bed can cause injury to the skin;

(9) Draw bed sheets used to lift or turn: Draw bed sheets used to lift or turn has been widely used to help changing the bed sheet. However, it needs high level of training and it is not without pain and discomfort;

(10) Turning the patient: In hospitals, it is a standard procedure to turn or roll a patient in bed every two hours to avoid skin breakdown and bedsores from developing, as these complication is associated with significant distress to both patient and caregiver and they are extremely difficult to treat when they occur. However, in some cases, at the very end, it will not be appropriate to turn the patient in bed, because this could be more disturbing or painful at the time;

(11) Changing the bed sheets: Changing the bed sheets job is very difficult, especially for the immobilized or paralyzed patient, and it needs a lot of patience and nursing technique. However, changing the bed sheets on a regular basis is extremely important not only because it can help patient feeling more comfortable; but also keeping clean and dry are part of preventing infection, skin breakdown, or bedsores, from happening;

(12) Dealing with urinary Incontinence and bowel Incontinence: If urinary and bowel incontinence are occurring on a regular basis, one will need to place incontinent pads underneath the patient. These can be reusable and washable (made of cloth) or disposable. One will also need to place incontinent briefs to absorb urine and help keep the skin dry. These will need to be changed and washed every few hours as needed as the pads are also used to collect feces and other discharges and must be removed before changing bed sheets.

U.S. Pat. No. 6,006,378 (Mitsuru Hayashi) discloses a bed which permits changing of bedclothes without moving the person on it and without substantial burden for either the patient or the care-taker. A left and a right carriage member 5 and 6, wheels 15 to 18 and a shaft 7 constitute a carriage. The carriage supports mats 11 and 12 via balancing members 3 and 4 and shafts 1 and 2 and advances the mats 11 and 12 along rails 31 and 32. The mat 12 is stretched between the rails 31 and 32 by fasteners. The balancing members 3 and 4 are rotatably coupled by a shaft to downward extensions *5a* and *6a* of the carriage members 5 and 6. The shafts 1 and 2 are rotatably mounted in the balancing members 3 and 4. With advancement of the carriage caused by turning a grip 26, the slides 52 and 54 cause the old mat 12 to be released from the fasteners and wound on the shaft 2, while also causing the new mat 11 to be coupled to the fasteners and stretched between the rails 31 and 32.

U.S. Pat. No. 6,594,837 (George Khait) discloses a service bed comprising a chassis, a guide mechanism movably supported by the chassis, and a mattress having an undulation formed by routing the mattress through the guide mechanism. The guide mechanism includes dispensing and collecting rollers for installing at least one first stratum between the mattress and the occupant of the service bed and for removing at least one second stratum installed between the mattress and the occupant.

U.S. Pat. No. 7,191,479 (Xiao-Zhou Cheng) discloses a hospital bed that changes bed sheets without moving the patient. It is composed of a bedstead (including a headboard, a footboard and a bed frame), a deformable bed top, a spool rack and roller shafts on both sides; the ends of the deformable bed top are fixed on the headboard and footboard respectively, and the bed top is pressed into between the roller axles by the spool rack which forms a tightened and leveled bed top that is sunken in the spool rack. Two bed sheets cover the bed, extending respectively from headboard and footboard into the spool rack and rolling on a roller axle. The roller axles and roller shafts are parallel to the cross section of the bed, and are movable between the headboard and footboard with the spool rack. When the spool rack is moving, one bed sheet is spread, another one is rolled up automatically.

This invention improves on the deficiencies of the prior art and provides an inventive bed apparatus which allows the seamlessly changing of bed-sheets while the bed is occupied by a person, and a method thereof

PURPOSES AND SUMMARY OF THE INVENTION

The invention is a novel ultimate comfort n care bed, and a bed apparatus capable of seamlessly changing bed sheets while being occupied by a person, a method of relieving ulcers, and a method thereof.

The inventive hospital bed contains multiple features that allow spool rack to transverse freely across a hospital bed mattress while removing/dispensing bed-sheets without moving the patient.

The inventive hospital bed also incorporates features that reduce the force required to move carriage assembly across the bed using a pulley assembly, a roller assembly, air bladders, belts, and any combination of them.

Therefore, one purpose of this invention is to provide a cost effective and durable hospital bed capable for allowing of seamlessly changing bed sheets while being occupied by a patient.

Another purpose of this invention is to provide a hospital bed where the changing mechanism for the bed sheets is below a patient and does not interfere with the comfort of the patient.

Another purpose of this invention is to provide an inventive mechanism where while a used bed sheet is being removed from the medical bed a new bed sheet is automatically being replaced in its place.

Therefore, in one aspect this invention comprises a medical bed apparatus for seamlessly changing bed sheets, comprising:

(a) a master bed frame having a first end and a second end, wherein said first end is secured to a headboard, and said second end is secured to a footboard;
(b) a primary mattress over said master bed frame, such that said primary mattress is positioned between said headboard and said footboard;
(c) at least one carriage assembly in engagement contact with said primary mattress and wherein said at least one carriage assembly is positioned between said headboard and said footboard;
(d) at least one tension arc assembly in pivotal contact with said primary mattress, and wherein said at least one tension arc assembly has at least one means to move said primary mattress from a first position to a second position; and
(e) at least one means to move said at least one carriage assembly over said primary mattress from a first position to a second position.

In another aspect this invention comprises a medical bed apparatus for seamlessly changing bed sheets, comprising:

(a) a master bed frame having a first end and a second end, wherein said first end is secured to a headboard, and said second end is secured to a footboard;
(b) a primary mattress over said master bed frame, such that said primary mattress is positioned between said headboard and said footboard;
(c) at least one carriage assembly in engagement contact with said primary mattress and wherein said at least one carriage assembly is positioned between said headboard and said footboard;
(d) at least one tension arc assembly in pivotal contact with said primary mattress, and wherein said at least one tension arc assembly has at least one means to move said primary mattress from a first position to a second position; and
(e) at least one pressure roller assembly in engagement contact with said at least one carriage assembly to move said at least one carriage assembly over said primary mattress from a first position to a second position.

In yet another aspect this invention comprises a medical bed apparatus for seamlessly changing bed sheets, comprising:

(a) a master bed frame having a first end and a second end, wherein said first end is secured to a headboard, and said second end is secured to a footboard;
(b) a primary mattress over said master bed frame, such that said primary mattress is positioned between said headboard and said footboard;
(c) at least one carriage assembly in engagement contact with said primary mattress and wherein said at least one carriage assembly is positioned between said headboard and said footboard;
(d) at least one tension arc assembly in pivotal contact with said primary mattress, and wherein said at least one tension are assembly has at least one means to move said primary mattress from a first position to a second position;
(e) at least one pressure roller assembly in engagement contact with said at least one carriage assembly to move said at least one carriage assembly over said primary mattress from a first position to a second position;
(f) at least one sliding magnet and at least one fixed magnet position in said pressure roller assembly, and wherein said at least one sliding magnet is in secure contact with a pressure relief rod, and wherein said at least one fixed magnet is in secure contact with a housing of said pressure roller assembly, and wherein said at least one fixed magnet and said at least one sliding magnet are utilized when said pressure roller moves from said first position to said second position.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

Figure 1B:
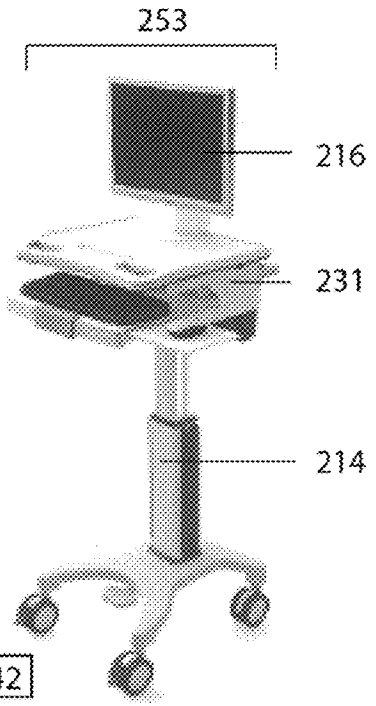
FIG. 1A, is a top elevation view of a hospital bed in accordance to one embodiment of the present invention in which the tension arc assembly is shown positioned in such a way as to pull down sections of the primary mattress while elevating others, while a remote access apparatus is shown in FIG. 1B.

The embodiments of the present invention are described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein. Rather, the disclosed embodiments are provided so that this disclosure will be thorough and complete, and will fully convey the scope of the invention to those skilled in the art.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

As shown in this invention, having the straps or the belts or the bladders or the mechanical carriage allows a service provider or a caregiver or a healthcare provider a much better access or room under the patient to remove the pads or mats or bed sheets while the patient or the person was still on the medical or hospital bed.

It would be advantageous to provide a hospital bed capable of seamlessly changing bed sheets while occupied by a patient because; it would be convenient to patients, caregivers, and healthcare providers by avoiding the traditional method, such as turning patient and/or lifting patient. It will reduce the cost of care for bedridden patient by decreasing the time spend and the number of the caregiver needed to assist in changing bed sheets. It will enhance safety of patients and caregivers by decreasing the hazard of physical injury and decreasing the health hazard of exposure to biological materials. It will help prevent pressure ulcers. Changing the bed sheet without moving the patient will eliminate the friction and shearing which are considered as major factor in development of pressure ulcer. It will reduce physical, psychological and emotional suffering that the bed bound patient and family are exposed to by using the traditional methods of changing the bed sheet. It would further be advantageous to provide a hospital bed capable of seamlessly changing bed sheets while occupied by a patient because it will reduce the risk of contamination and transmission of infectious by increasing the frequency of changing the bed sheet and minimizing the caregiver contact with patient's body and secretion. Belts or straps can be used also with alternating bladder mattress to reduce or prevent pressure ulcers and to change bed sheets.

A hospital bed that changes bed sheets without moving the patient. Comprised of a bedstead (foot/headboard), deformable bed top, spool rack and roller shafts on both sides. The ends of the deformable bed top are fixed on the head and footboard. The bed is pressed into and between the roller axles by the spool rack which forms a tightened and leveled bed top that is sunken in the spool rack. The two bed sheets cover the bed from head to foot board into spool rack and rolling on a roller.

As shown in FIGS. 1A through 6, a medical or a hospital bed 201, is capable of seamlessly changing bed sheets while being occupied by a patient, which includes a headboard 205 and footboard 202, connected to one another via a master bed frame 203 which utilizes a series of pivoting tension arcs 207 and a pressure roller assembly 256 atop of which there is placed a secondary mattress frame 212 and a primary mattress 213. When each tension arc 207 is in its default horizontal position it is parallel to the ground. However, because the mattress is firmly encircled by a series of top belts 206 which are affixed to the ends of the tension arcs 207, as each tension arc 207 pivots, one side is elevated and pushes up the corresponding pressure roller assembly 256, while the opposite side is lowered. This movement of the tension arc assembly 219 causes the primary mattress 213 to deform both downwards and upwards and creates a space into which the carriage assembly 215 can fit and freely move therein. As the carriage assembly 215 continues to be guided along the carriage sliding frame 209 via a series of gears, a gear rack 233, a threaded carriage rod 230 and a carriage motor 228, the top belts 206 in front of the carriage are pulled down by the tension arc 207 underneath to create a new pocket while the tension arcs 207 behind it are elevated by the pressure roller assembly 256 and back to its default horizontal position. In this way, the tension arc assembly 219 is able to apply pressure to the various top belts 206 passing through the top of the primary mattress 213 and from underneath it such a way as to create moving pockets large enough to allow the carriage assembly 215 to pass freely over the primary mattress 213 from one end of the bed to another without tension. In addition to seamlessly changing bed sheets, the hospital bed 201 is also capable of providing automated pressure relief to immobile patients via a wireless pressure controller assembly 253. This is achieved by using a pressure mat 211 placed above the primary mattress 213 and underneath the bed sheets to automatically sense various pressure area made by a patient's body and transmits this information to a pressure controller 216. The pressure controller 216 thereafter analyzes the information received the pressure mat 211 regarding the various pressure areas made by a patient's body, determines which pressure areas need to be relieved and transmits this information to the wireless controller 231. The wireless controller 231 takes these commands from the pressure controller 216 and transmits them to the tension arc assembly 219 to reposition itself to relieve pressure from specific pressure areas of the patient as gathered by the pressure mat 211. A pressure controller carriage 214 is used to hold the pressure area controller and allowing it to be moved easily.

Figure 1A:
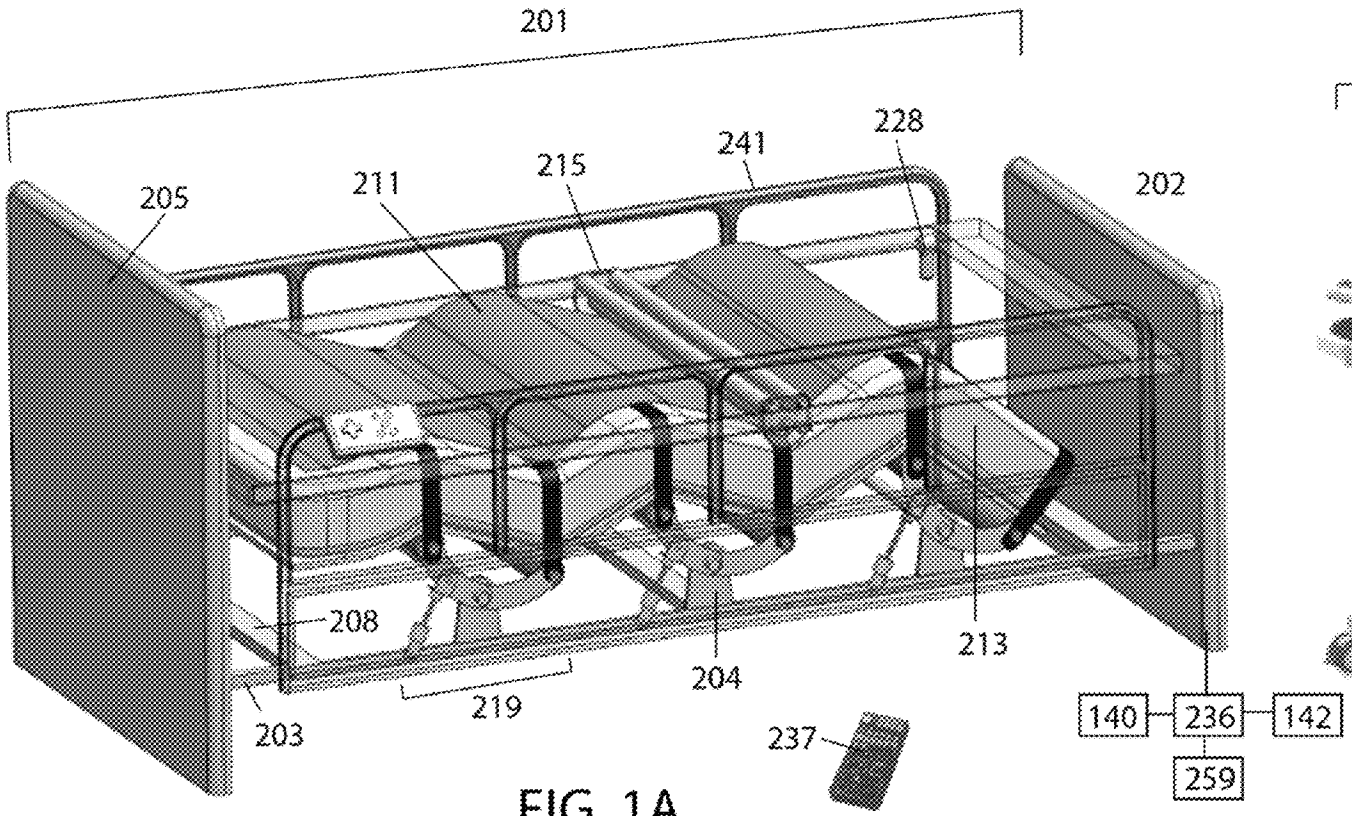

Referring now to the FIGS. 1A to 6, where FIG. 1A is a top elevation view of a medical or a hospital bed 201 in accordance to one embodiment of the present invention in which the tension arc assembly 219 is shown positioned in such a way as to pull down sections of the primary mattress 213 while elevating others, while a remote access apparatus 253, is shown in FIG. 1B. Referring to FIG. 1A, the hospital bed 201, includes a headboard 205 and footboard 202 held together by a master bed frame 203 to which there is attached a tension arc assembly 219, a primary mattress 213, a carriage assembly 215. Mounted along the sides of the master bed frame 203 is a series of arc mounting brackets 204. Hinged side rails 241 are used for support and to protect the patient from falling out of bed will be attached to the master bed frame 203. Several support beams 208 cross under the master bed frame 203 providing it additional structural stability. A remote 237 is available to allow the patient and/or caregiver to control the movement of various parts of the bed and to relieve pressure from specific areas thereof manually. A pressure controller assembly 253, comprised of a pressure mat 211, a pressure controller 216, a wireless controller 231 and a pressure controller carriage 214 is also shown.

Figure 2:
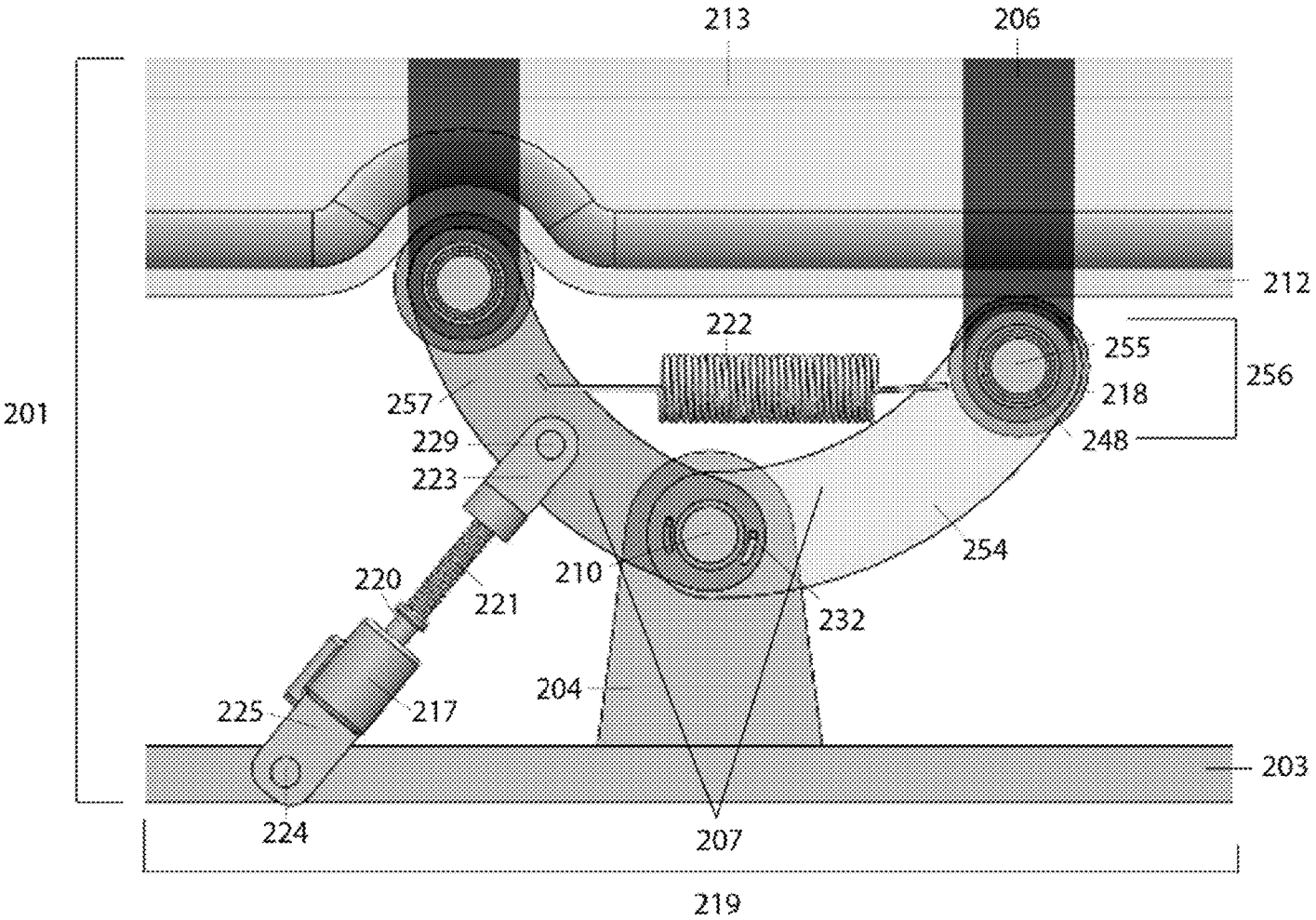
FIG. 2 is a detail view of a hospital bed in accordance to one embodiment of the present invention in which the tension arc assembly is enlarged to show greater detail.
Figure 6:
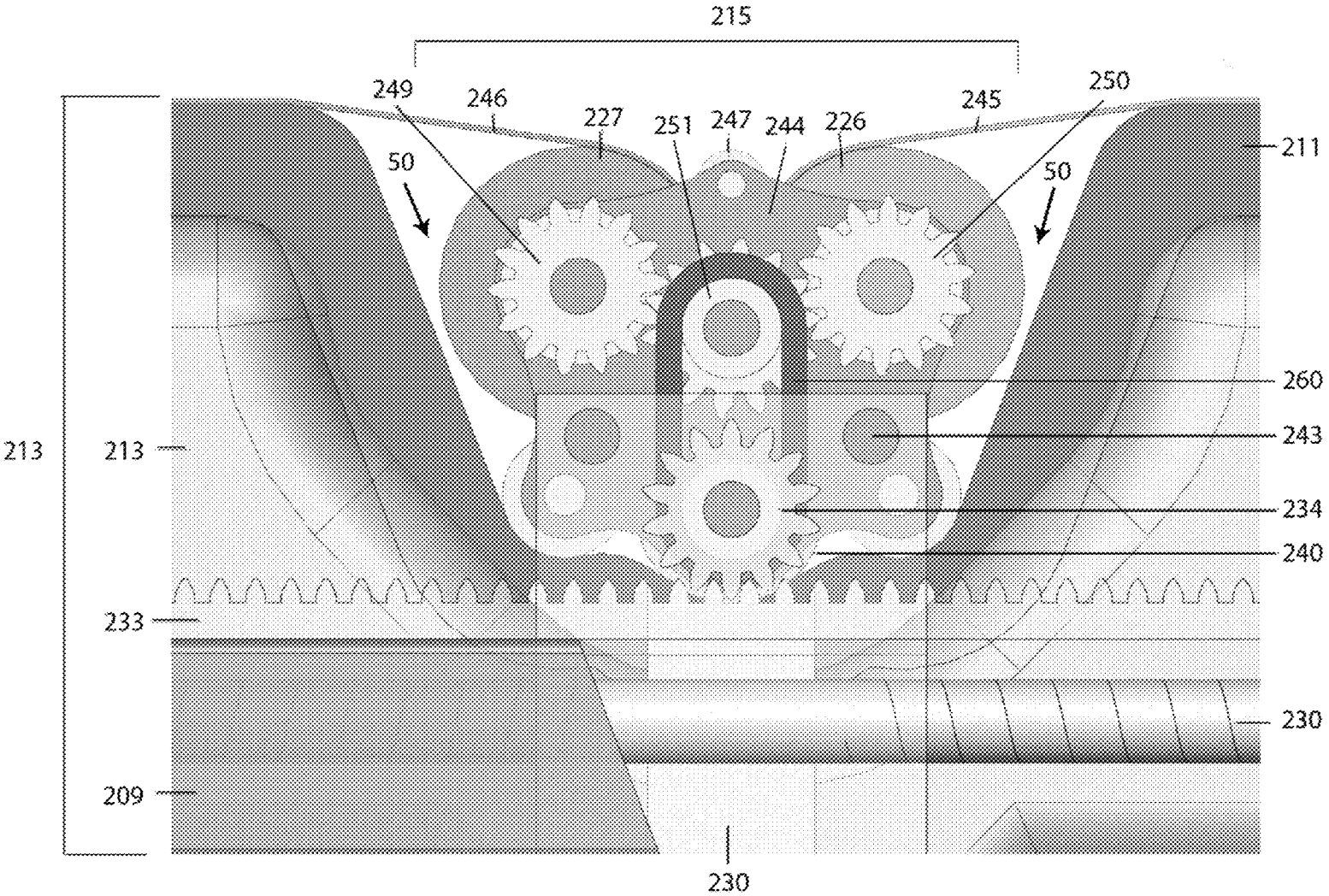
FIG. 6 shows hospital bed in accordance to one embodiment of the present invention in which the carriage assembly is enlarged to show greater detail.

FIG. 2 shows a hospital bed 201 in accordance to one embodiment of the present invention in which the tension arc assembly 219 is enlarged to show greater detail. Centered above each mounting bracket 204 rests a U-shaped tension arc 207 which pivots on an arc center shaft 210. The tension arc 207 is comprised of right arc 254 and a left arc 257. A tension spring 222 runs between the right arc 254 and the left arc 257. Both ends of the tension arc 207 feature a pressure roller assembly 256 comprised of an arc roller shaft 255 and an arc pressure roller 218 and a set of bearings 248, atop of which rests a flexible secondary mattress frame 212 which supports the primary mattress 213. Attached to either end of the pressure roller assembly 256 is a top belt 206 which stretches up and through the upper section of the primary mattress 213. Attached to one end of each pivoting tension arc 207 is a arc mounting pin 229 upon which pivots a threaded motor collet 223 into which a threaded arc rod 221 is inserted. The other end of the threaded arc rod 221 is attached to an arc motor 217 via a motor collet 220. Each arc motor 217 is held by a motor mounting frame 225 which pivots on a motor mounting pin 224 and is attached to the master bed frame 203. When the tension arc 207 is in its default horizontal position parallel to the ground. When the arc motor 217 rotates, the threaded arc rod 221 will interact with the threaded motor collet 220 and will push or pull one end of the tension arc 207 up or down depending on the direction of its rotation. A dowel pin 232 is attached to the right arc 254 and the left arc 257 respectively and is inserted into a curved slot on the opposite side of each tension arc 207. This dowel pin 232 is used to regulate the speed at which either side of the tension arc 207 can pivot. When one side of the tension arc 207 is pushed up it continues to be pushed up independently until the dowel pin 232 of the opposite side hits reaches the end of the curved slot. At this point the entire tension arc 207 begins to rotate, pushing up one side of the pressure roller assembly 256 and pulling down the top belts 206 on the other. Thus, because the top belts 206 firmly encircle the primary mattress 213, as one side of the of the tension arc 207 is elevated, the opposite side of the same tension arc 207 is lowered causing the primary mattress 213 to deform. This deformation will thus create a pocket 50, into which the carriage assembly 215 can fit. As the carriage motor 228 begins to turn engaging with the gear rack 233 The carriage assembly 215 is thus able to traverse from one side of the bed to the other, rolling up a used sheet 245 and rolling out a new bed sheet 246 simultaneously, as shown in FIG. 6, as the tension arc assembly 219 maneuvers to allow the carriage assembly 215 space to freely move therein. The tension are assembly 219 will thus be able to both relieve pressure from beneath the patient's body and create enough space for the carriage assembly 215 to complete the bed sheet changing process.

Figure 3A:
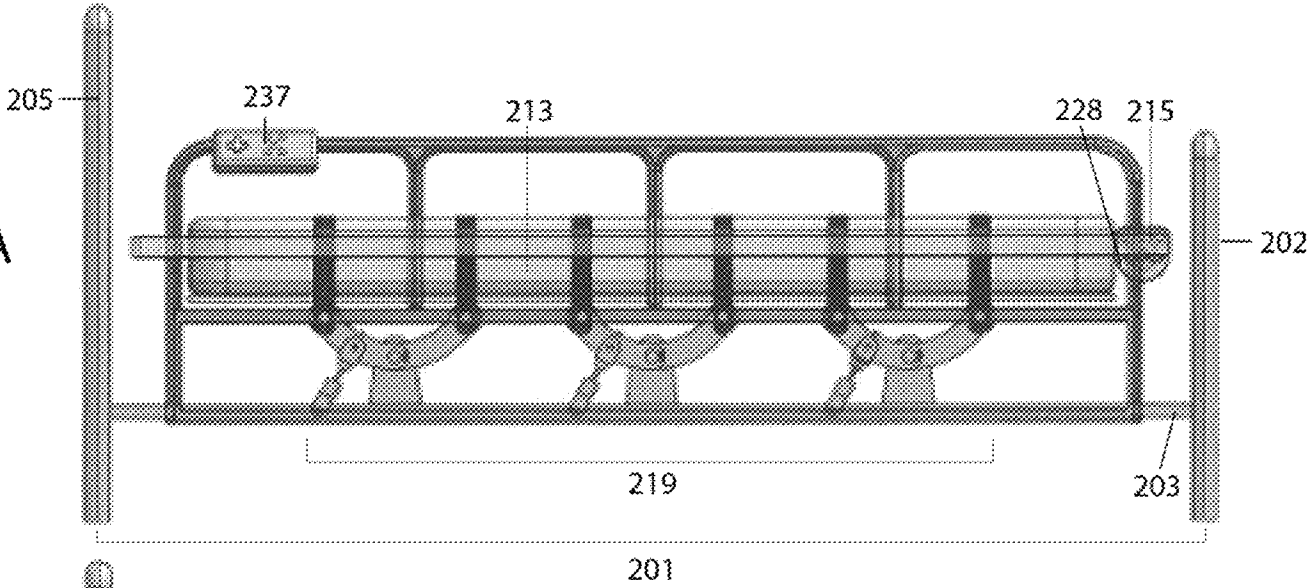
FIG. 3A is an side view of the hospital bed in accordance to one embodiment of the present invention in which the tension are assembly is shown positioned in such a way that the primary mattress is in its default horizontal position.

FIG. 3A is an side view of the hospital bed 201 in accordance to one embodiment of the present invention in which the primary mattress 213 in a default horizontal position in which the tension are assembly 219, the carriage assembly 215 and bed assembly 258 are shown.

Figure 3B:
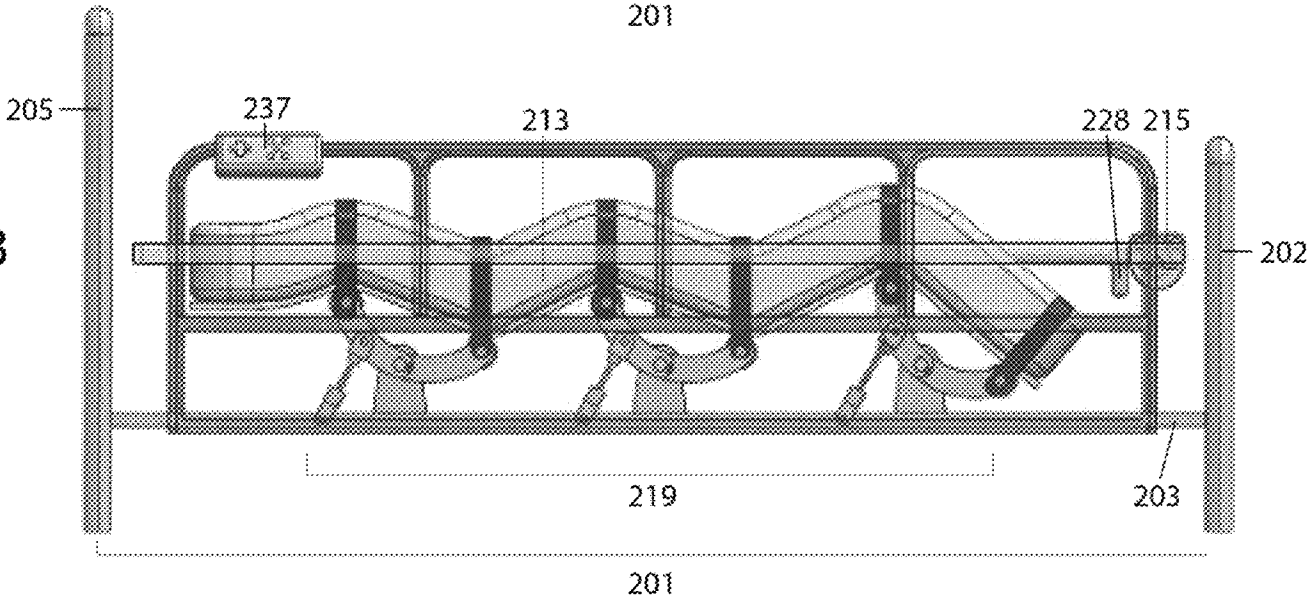
FIG. 3B is an side view of the hospital bed in accordance to one embodiment of the present invention in which the tension arc assembly is shown positioned in such a way as to pull down sections of the primary mattress while elevating others.

FIG. 3B is an side view of the hospital bed 201 in accordance to one embodiment of the present invention in which the primary mattress 213 being deformed by the tension are assembly 219 to demonstrate how pressure can be relieved from beneath the patient's neck, shoulder, buttocks and foot area and/or how the space can be created for the carriage assembly 215 to be able to complete the bed sheet changing process.

Figure 4:
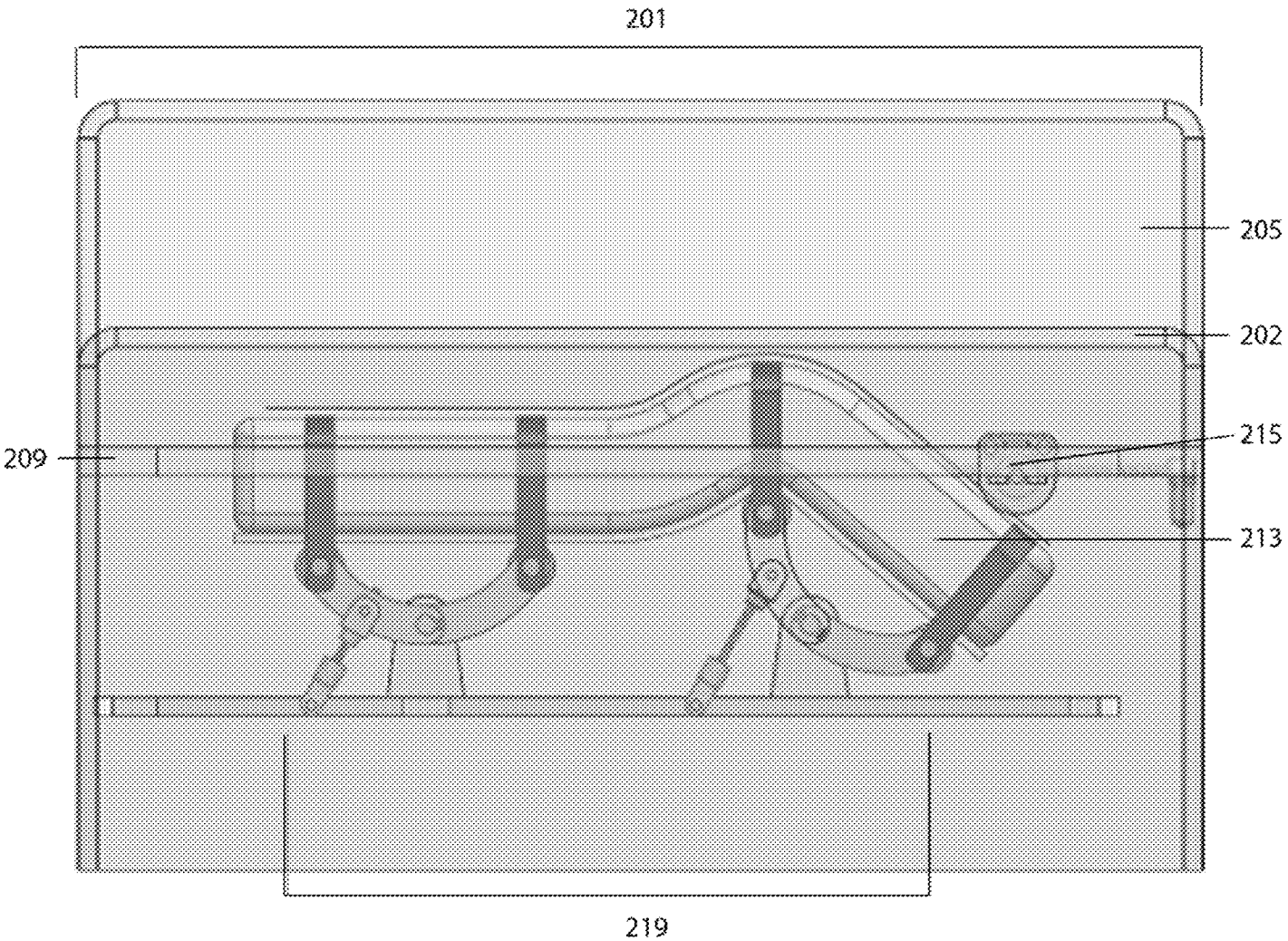
FIG. 4 is an front view of a hospital bed in accordance to a second embodiment of the present invention in which the tension arc assembly is shown positioned in such a way as to pull down sections of the primary mattress while elevating others.

FIG. 4 is an front view of a hospital bed 201, in accordance to a second embodiment of the present invention in which the primary mattress 213 being deformed by the tension arc assembly 219 to demonstrate how pressure can be relieved from beneath the patient's neck, shoulder, buttocks and foot area and/or how the space can be created for the carriage assembly 215 to be able to complete the bed sheet changing process as it slides along the carriage sliding frame 209. In the second embodiment, the tension arc assembly 219 can be placed under the primary mattress 213 at the head and foot of the bed instead of along the length of the bed as was demonstrated in the first embodiment.

Figure 5:
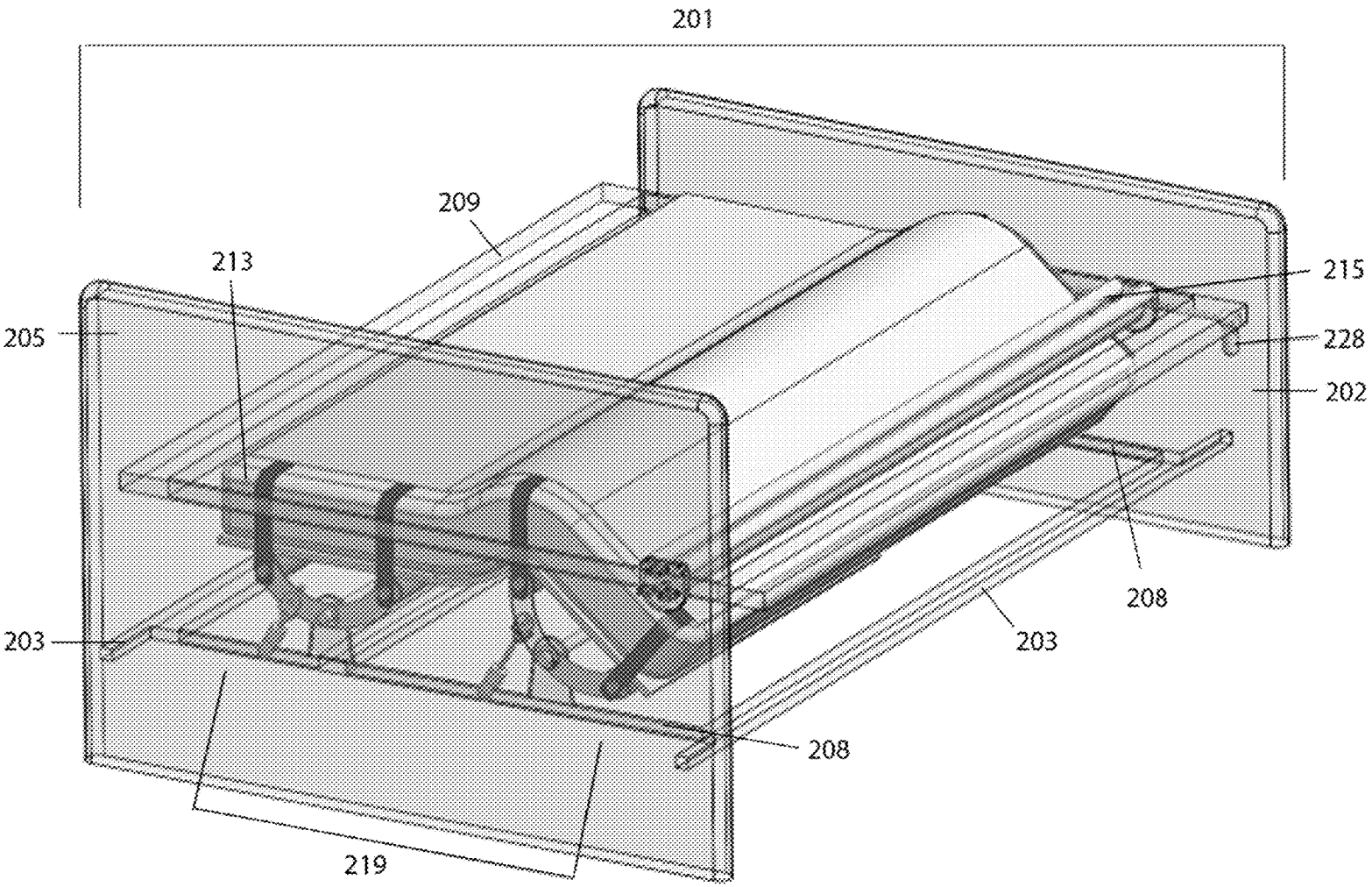
FIG. 5 is an elevated view of a hospital bed in accordance to a second embodiment of the present invention in which the tension arc assembly is shown positioned in such a way as to pull down sections of the primary mattress while elevating others.

FIG. 5 is an elevated view of a hospital bed 201, in accordance to a second embodiment of the present invention in which the primary mattress 213 being deformed by the tension arc assembly 219 to demonstrate how pressure can be relieved from beneath the patient's neck, shoulder, buttocks and foot area and/or how the space can be created for the carriage assembly 215 to be able to complete the bed sheet changing process as it slides along the carriage sliding frame 209. In the second embodiment, the tension arc assembly 219 can be placed under the primary mattress 213 at the head and foot of the bed instead of along the length of the bed as was demonstrated in the first embodiment. The carriage motor 228 used for moving the carriage assembly 215 is also shown.

FIG. 6 shows hospital bed 201 in accordance to one embodiment of the present invention in which the carriage assembly 215 is enlarged to show greater detail. The carriage assembly 215 is held together by series of mounting rods 243 and a mounting bracket 244 on either end on the top of which there are inserted a used sheet roller 226 and a new sheet roller 227 parallel to one another. Between these sheet rollers 226, 227, and at a slightly higher level, there is located a padded support roller 247 which prevents the patient's back from touching the rotating sheet rollers 226, 227, as they simultaneously roll up the used sheet 245 and roll out the new sheet 246 as the carriage assembly 215 moves across the bed 201. Bearings 248, as shown in FIG. 2, are placed throughout the holes of the mounting bracket 244 to facilitate the free rotation of the attached rollers and gears. The carriage assembly 215 also includes a series of belts, gears and slip clutches which work together to both move the carriage across the bed as well as complete the bed changing process at the same time. This is accomplished using a used bed sheet roller gear 250 and a new bed sheet roller gear 249 which are attached to both ends of the used bed sheet roller 226 and new bed sheet roller 227 respectively. A slip clutch 252, is inserted onto either end of the bed sheet rollers 226, 227, between the mounting bracket 244, and the roller gears 250, 249, to prevent bed sheet rollers from rotating when anything obstructs the rolling process the used and new bed sheets, in order to protect the patient and bed components from being injured and damaged. The used bed sheet roller 226 gears and new bed sheet roller gear 249 are connected via a center belt gear 251 located at the center of the mounting bracket 244. Depending on the direction of the rotation of the center belt gear 251, the bed sheet gears will either rotate clockwise or counter-clockwise in conjunction with the movement of the carriage assembly 215 in such a way that the used bed sheet roller 226 rolls up the used bed sheet 245 while the new bed sheet roller 227 rolls up the new bed sheet 246. The center belt gear 251 is connected to the master rack gear 234 via a center belt 260 which transfers the rotation of the master rack gear 234 to the center belt 260 which in turn, rotates both bed sheet gears. The master rack gear 234 engages a gear rack 233 affixed the carriage sliding frame 209. The carriage assembly 215 is moved from one end of the bed to the other by a carriage motor 228, shown in FIG. 1A, to which there is attached a threaded carriage rod 230. At the base of the mounting plate 235 there is attached a threaded hole 238, into which the threaded carriage rod 230 is inserted. As the threaded carriage rod 230 rotates, so does the master rack gear 234 moving the carriage along the sides of the bed and starting the bed changing process. A master rack gear 234 is affixed to both ends of a master pressure roller 240 that works in conjunction with the top belts 206 to apply downward pressure on the top mattress and primary mattress 213 to create clearance for the carriage assembly 215 to freely move across the bed. For safety reasons, a gear cover 265, is used to cover all exposed gears and belts of the carriage assembly 215. Located within the control box 236, there is a CPU (Central Processing Unit) 140, a power supply 142, and any other necessary parts to make the hospital bed 201, function along with a programmable logic control (PLC) 259, to determine the sequence of operation for the entire hospital bed 201.

As shown in FIGS. 7 through 14B, a hospital bed 401, is capable of seamlessly changing bed sheets while being occupied by a patient, which includes a headboard 405 and footboard 402, connected to one another via a master bed frame 403 which utilizes a series of pressure rollers 436 atop of which there is placed a flexible secondary mattress frame 450 and a primary mattress 413. A carriage assembly 415 is used to move across the top of the primary mattress 413 while dispensing and collecting new and used bed sheets without disturbing the patient occupying the bed space. Attached to the carriage assembly 415 is a pressure roller assembly 428 which features a channeled roller plate 454 which interacts with the series of pressure rollers 436 which run lengthwise under the hospital bed 401 supporting the secondary mattress frame 450 and the primary mattress 413 resting on top of it in such a way as to pull down a series of roller belts 435 to apply downward pressure to the primary mattress 413 and create a moving space into which the carriage assembly 415 can fit to facilitate the free movement across the top of the primary mattress 413 to complete the bed sheet changing process. In addition to seamlessly changing bed sheets, the hospital bed 401 is also capable of providing automated pressure relief to patients via a pressure relief assembly 436 located within the primary mattress 413 and a the movement of the tension arc assembly 419 underneath it.

Figure 7:
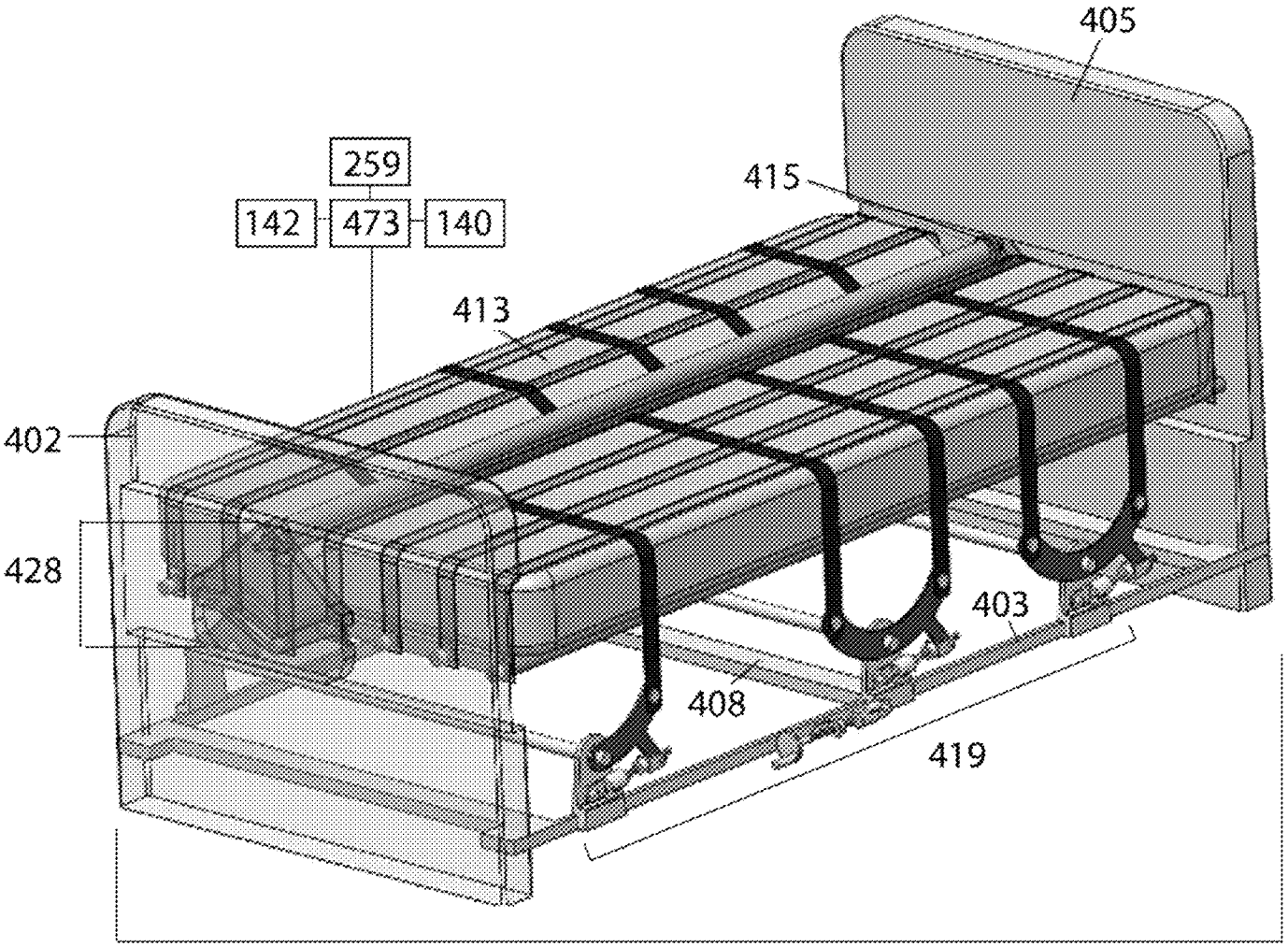
FIG. 7 is a top elevation view of a hospital bed in accordance to another embodiment of the present invention in which the tension arc assembly, the pressure roller assembly and the carriage assembly are shown.

Referring now to the FIGS. 7 through 14B, where FIG. 7, is a top elevation view of a hospital bed in accordance to another embodiment of the present invention in which the tension arc assembly 419, the pressure roller assembly 428 and the carriage assembly 415 are shown. Referring to FIG. 7, the hospital bed 401, includes a headboard 405 and footboard 402 held together by a master bed frame 403 to which there is attached a tension arc assembly 419, a pressure roller assembly 428, a carriage assembly 415 and a primary mattress 413. Mounted along the sides of the master bed frame 403 is a series of sliding arc mounting brackets 204. Several support beams 408 cross under the master bed frame 403, providing it additional structural stability. Located within the control box 473, there is a CPU (Central Processing Unit) 140, a power supply 142, and any other necessary parts to make the hospital bed 401, function along with a programmable logic control (PLC) 259, to determine the sequence of operation for the entire hospital bed 401.

Figure 8:
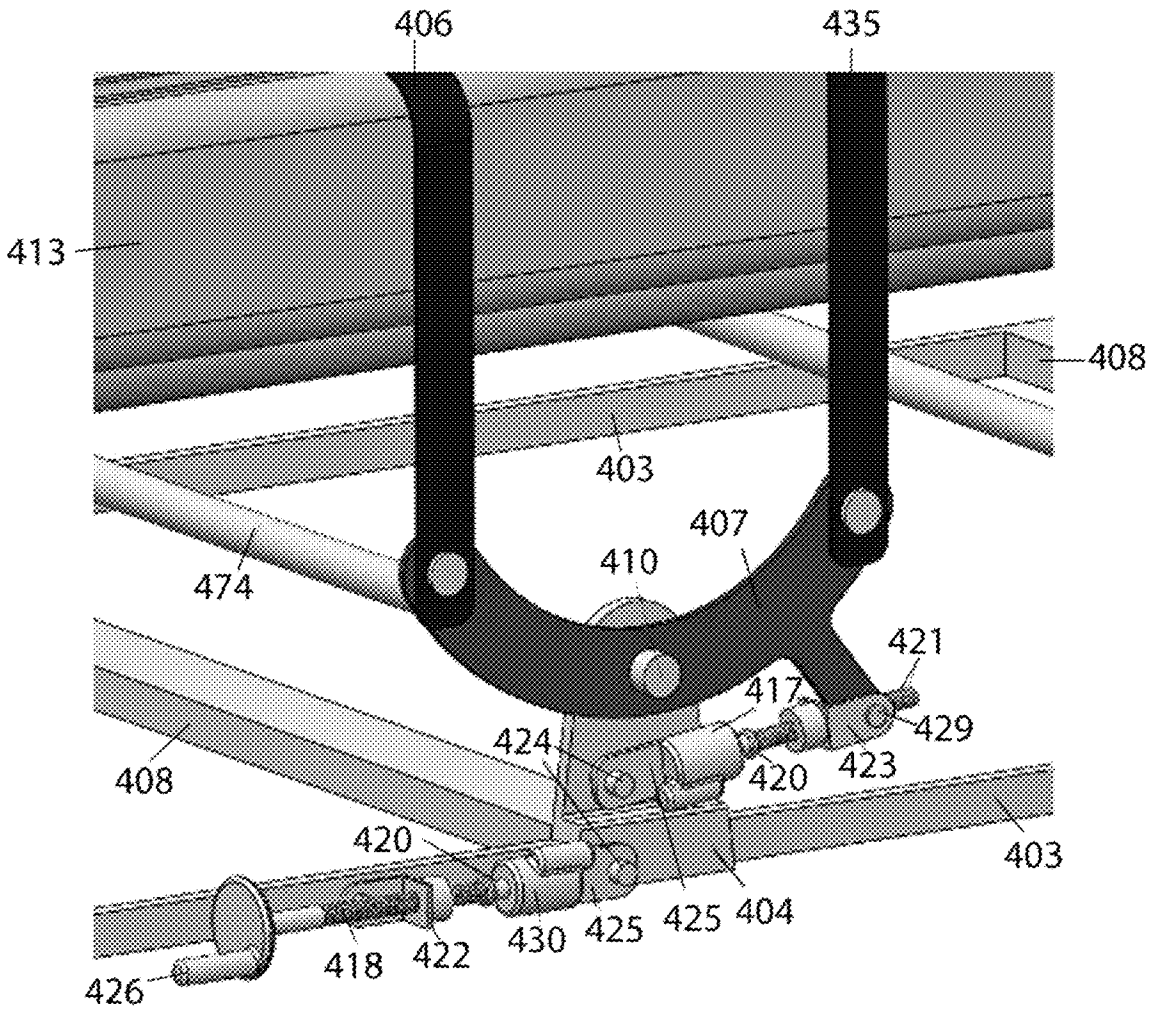
FIG. 8 is a detail view of a hospital bed in accordance to another embodiment of the present invention in which the tension arc assembly is enlarged to show greater detail.

FIG. 8 shows a hospital bed 401 in accordance to another embodiment of the present invention in which the tension arc assembly 419 is enlarged to show greater detail. Centered above each sliding mounting bracket 404 rests a U-shaped tension arc 407 which pivots on a tension arc pin 410. A connecting rod 474 is used to connect either end of the tension arcs 407 together to ensure they rotate at the same angle. Attached to either end of the tension are assembly 419 is a top belt 435 which stretches up and through the upper section of the primary mattress 413. Attached to one end of each pivoting tension arc 407 is a are mounting pin 429 upon which pivots a threaded motor collet 423 into which a threaded arc rod 421 is inserted. The other end of the threaded are rod 421 is attached to an are motor 417 via a motor collet 420. Each arc motor 417 is held by a motor mounting frame 425 which pivots on a motor mounting pin 424 and is attached to the master bed frame 403. When the tension arc 407 is in its default horizontal position parallel to the ground. When the arc motor 417 rotates, the threaded arc rod 421 will interact with the threaded motor collet 420 and will push or pull one end of the tension arc 407 up or down depending on the direction of its rotation. As the tension arc 407 begins to rotate and one side is pushed up loosening the one side of the top belts 406, the top belts 406 on the other side are pulled down. Thus, because the top belts 406 firmly encircle the primary mattress 413, as one side of the of the tension arc 407 is elevated, the opposite side of the same tension arc 407 is lowered along with the top belts 406 causing the primary mattress 413 to deform. Because the top belts 406 are positioned under the shoulder, buttocks and foot area of the patient above the primary mattress, the tension arc assembly 419 will be able to relieve pressure from the patient's neck, shoulder, buttocks and foot areas to reduce the likelihood of bedsores and/or other similar pressure related conditions and to facilitate patient healing. The sliding mounting brackets 404 to which each tension arc 407 assembly is connected is made adjustable due to the fact that patient height is variable and the distance between the shoulders, buttocks and foot area will differ from patient to patient. The location of tension arc assembly 419 is adjusted by a threaded adjustment rod 418 which passes through a fixed nut 422 which is attached to the master bed frame 403. One end of the threaded adjustment rod 418 is connected to an adjustment motor 430 via a motor collet 423. The adjustment motor 430 is held by a motor mounting frame 425 which is connected to the sliding mounting bracket 404 via a motor mounting pin 424. As the threaded adjustment rod 418 rotates it will interact with the fixed nut 422 causing the sliding mounting bracket 404 to move forward or backwards along the master bed frame 403. Thus, the location tension arc assembly 419 can be adjusted electronically using an adjustment motor 430 or manually using a hand crank 426 attached to the other end of the threaded adjustment rod 418.

Figure 9:
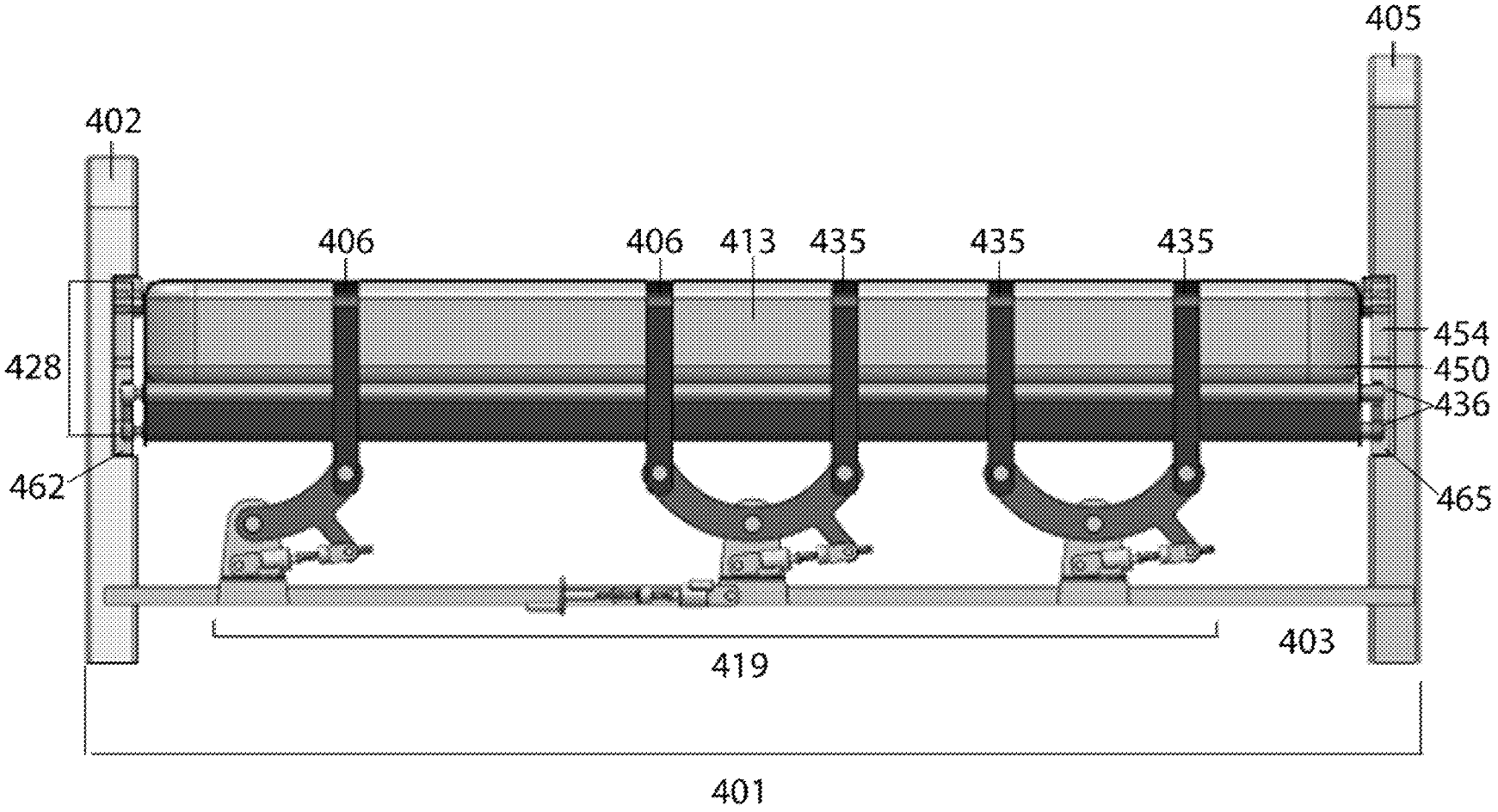
FIG. 9 is an side view of the hospital bed in accordance to another embodiment of the present invention in which the tension arc assembly is shown positioned in such a way that the primary mattress is in its default horizontal position.
Figure 10A:
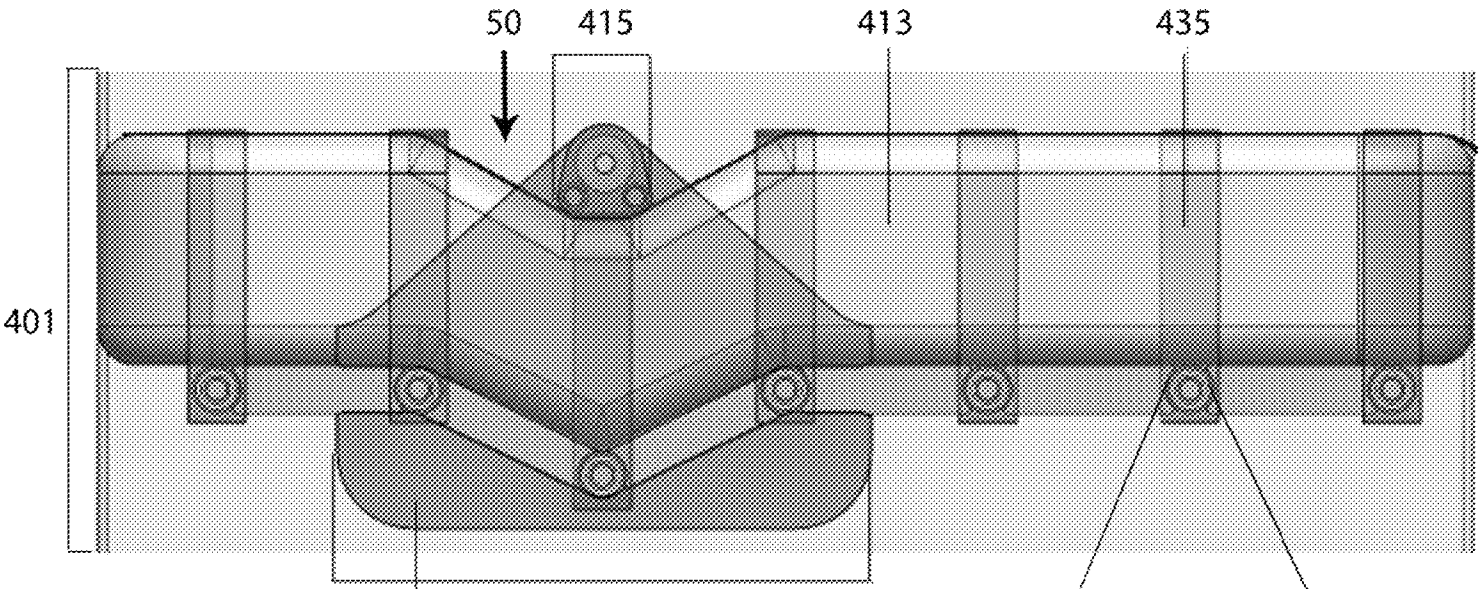
FIG. 10A is a front view of a hospital bed in accordance to another embodiment of the present invention in which the pressure roller assembly and carriage assembly are shown positioned in such a way as to pull down sections of the primary mattress while supporting others, while a pressure roller in an enlarged view to show greater detail is shown in FIG. 10B.
Figure 10B:
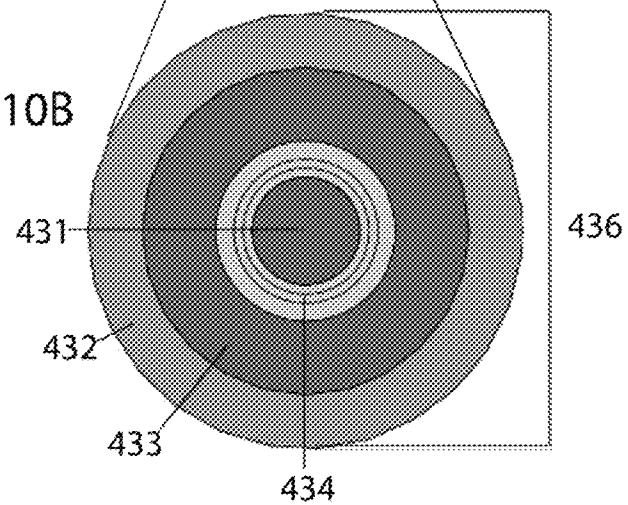

FIG. 9 is an side view of the hospital bed 401 in accordance to another embodiment of the present invention in which the tension arc assembly 419, is shown positioned in such a way that the primary mattress 413 is in its default horizontal position. The headboard 405, footboard 402, primary mattress 413, are shown. The pressure rollers 436 of the pressure roller assembly 428 are visible crossing under the secondary mattress frame 450 supporting the primary mattress 413. Either end of the pressure rollers 436 are connected to the headboard 405 and footboard 402 and can be manipulated by the channeled roller plate 454 of the pressure roller assembly 428 as it passes over them. The pressure roller assembly 428 can be seen situated inside a channel or pocket or opening 472, in the headboard 405, and a channel or pocket or opening 462, in the footboard 402, at respective ends of the hospital bed 401. The tension arc assembly 419 is shown positioned in such a way as to relieve pressure from beneath the patient's neck, shoulder, buttocks and foot area once activated.

FIG. 10 is an front view of a hospital bed 401 in accordance to another embodiment of the present invention in which the pressure roller assembly 428 and carriage assembly 415 are shown positioned in such a way as to pull down sections of the primary mattress 413 while supporting others. A pressure roller 436 is enlarged to show greater detail. The pressure roller assembly 436 is comprised of a series of pressure rollers 436, roller belts 435 and a channeled roller plate 454 connected to the carriage assembly 415. The mattress is firmly encircled by a series of roller belts 435 which are affixed to the ends of the pressure rollers 436. Each pressure roller is comprised of a center shaft 431, a protruding bearing 434, rubber disk 433 and a foam sleeve 432. The protruding bearings 434 at either end of the pressure rollers 436 pass through the channeled roller plate 454 in such a way as to pull down one pressure roller 436 and its corresponding roller belt 435 at a time. Thus, the roller belts 435 in front of the carriage assembly 415 are pulled down by the pressure rollers 436 underneath to create a new pocket 50, while the roller belts 435 behind will be loosened, causing the pressure rollers 436 to push the other sections of the primary mattress 413 back to its default horizontal position. In this way, the pressure roller assembly 428 is able to apply pressure to the primary mattress 413 in such a way as to create moving pockets large enough to allow the carriage assembly 415 to pass freely over hospital bed 401 from one end of the bed to another without tension to complete the bed sheet changing process.

Figure 11:
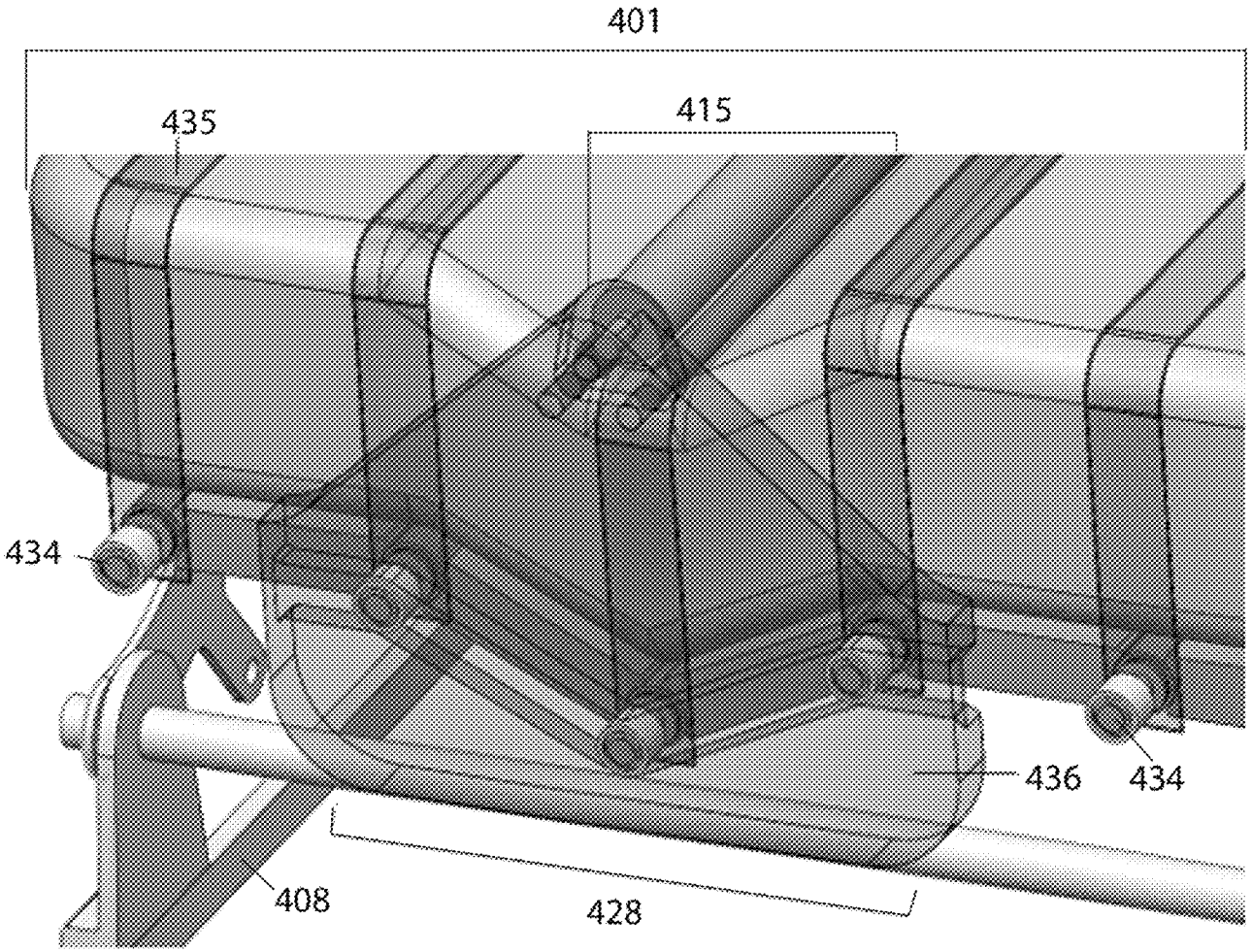
FIG. 11 is an elevated view of a hospital bed in accordance to another embodiment of the present invention in which the pressure roller assembly and carriage assembly are shown positioned in such a way as to pull down sections of the primary mattress while supporting others.

FIG. 11, is an elevated view of a hospital bed 401, in accordance to another embodiment of the present invention in which the pressure roller assembly and carriage assembly are shown positioned in such a way as to pull down sections of the primary mattress while supporting others. The carriage assembly 415 is guided along the carriage sliding frame 409 located within the headboard 405 and the footboard 402, via a series of gears, a gear rack 433, a threaded carriage rod 451 and a carriage motor 451. As the carriage motor 452 begins to turn engaging with the gear rack 433, it pushes the carriage assembly 415 from one side of the bed to the other, rolling up a used bed sheet 455 and rolling out a new bed sheet 456 simultaneously, as the as the pressure roller assembly 428 maneuvers to allow the carriage assembly 415 space to freely move therein.

Figure 12:
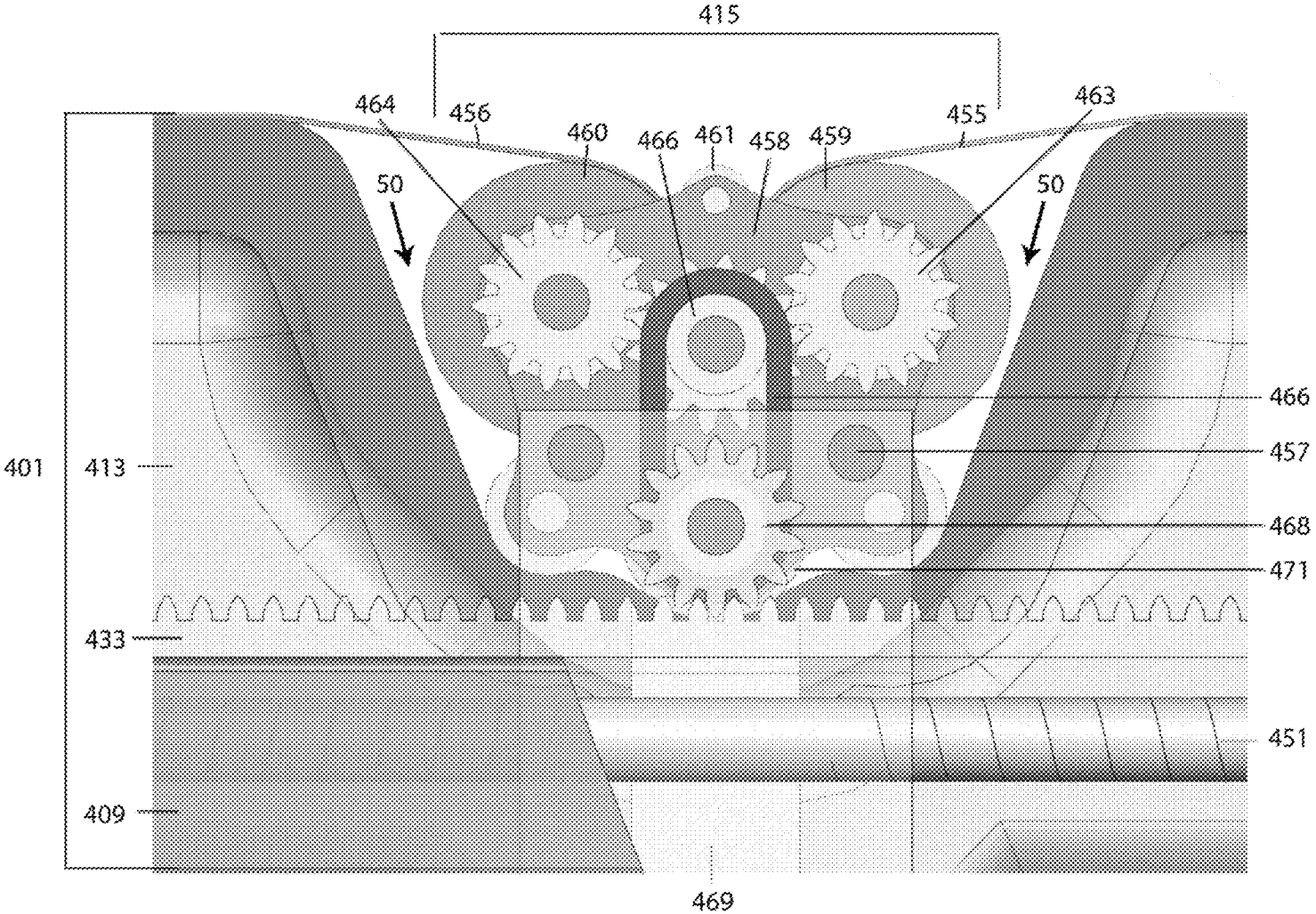
FIG. 12 is a detail view of a hospital bed in accordance to another embodiment of the present invention in which the carriage assembly is enlarged to show greater detail.

FIG. 12, shows hospital bed 401 in accordance to another embodiment of the present invention in which the carriage assembly 415 is enlarged to show greater detail. The carriage assembly 415 is held together by series of mounting rods 457 and a mounting bracket 458 on either end of the carriage assembly 415 on the top of which there are inserted a used bed sheet roller 459 and a new bed sheet roller 460 parallel to one another. Between these bed sheet rollers and at a slightly higher level, there is located a padded support roller 461 which prevents the patient's back from touching the rotating bed sheet rollers 459, 460, as they simultaneously roll up the used bed sheet 455 and roll out the new bed sheet 456 as the carriage assembly 415 moves across the bed 401. Bearings 248, are placed throughout the holes of the mounting bracket 458 to facilitate the free rotation of the attached rollers and gears. The carriage assembly 415 also includes a series of belts, gears and slip clutches which work together to both move the carriage across the bed as well as complete the bed changing process at the same time. This is accomplished using a used bed sheet roller gear 463 and a new bed sheet roller gear 464 which are attached to both ends of the used bed sheet roller 459 and new bed sheet roller 460 respectively. A slip clutch 465, is inserted onto either end of the bed sheet rollers 459, 460, between the mounting bracket 458, the roller gears to prevent bed sheet rollers 459, 460, from rotating when anything obstructs the rolling process of the used bed sheet 455, and the new bed sheet 456, in order to protect the patient and bed components from being injured and damaged. The used bed sheet roller gears 463, and the new bed sheet roller gear 464, are connected via a center belt gear 467, located at the center of the mounting bracket 458. Depending on the direction of the rotation of the center belt gear 467, the bed sheet gears will either rotate clockwise or counter-clockwise in conjunction with the movement of the carriage assembly 415 in such a way that the used bed sheet roller 459 rolls up the used bed sheet 455 while the new bed sheet roller 460 rolls up the new bed sheet 456. The center belt gear 467 is connected to the master rack gear 468 via a center belt 466 which transfers the rotation of the master rack gear 468 to the center belt 466 which in turn, rotates both bed sheet gears. The master rack gear 468 engages a gear rack 433 affixed the carriage sliding frame 409. The carriage assembly 415 is moved from one end of the bed to the other by a carriage motor 228, shown in FIG. 1A, to which there is attached a threaded carriage rod 451. At the base of the mounting plate 469 there is a threaded hole 470, into which the threaded carriage rod 451 is inserted. As the threaded carriage rod 451 rotates, so does the master rack gear 468 moving the carriage along the sides of the bed and starting the bed changing process. A master rack gear 468 is affixed to both ends of a master pressure roller 471 that works in conjunction with the roller belts 435 to apply downward pressure on the primary mattress 413 to create clearance or pocket 50, for the carriage assembly 415, to freely move across the bed 401. For safety reasons, a gear cover 265, is used to cover all exposed gears and belts of the carriage assembly 415. The pressure roller assembly 428 is attached to the mounting plate 469 of the carriage assembly 415 in such a way as to facilitate the movement of both assemblies simultaneously to assist each other in the bed sheet changing process.

Figure 13B:
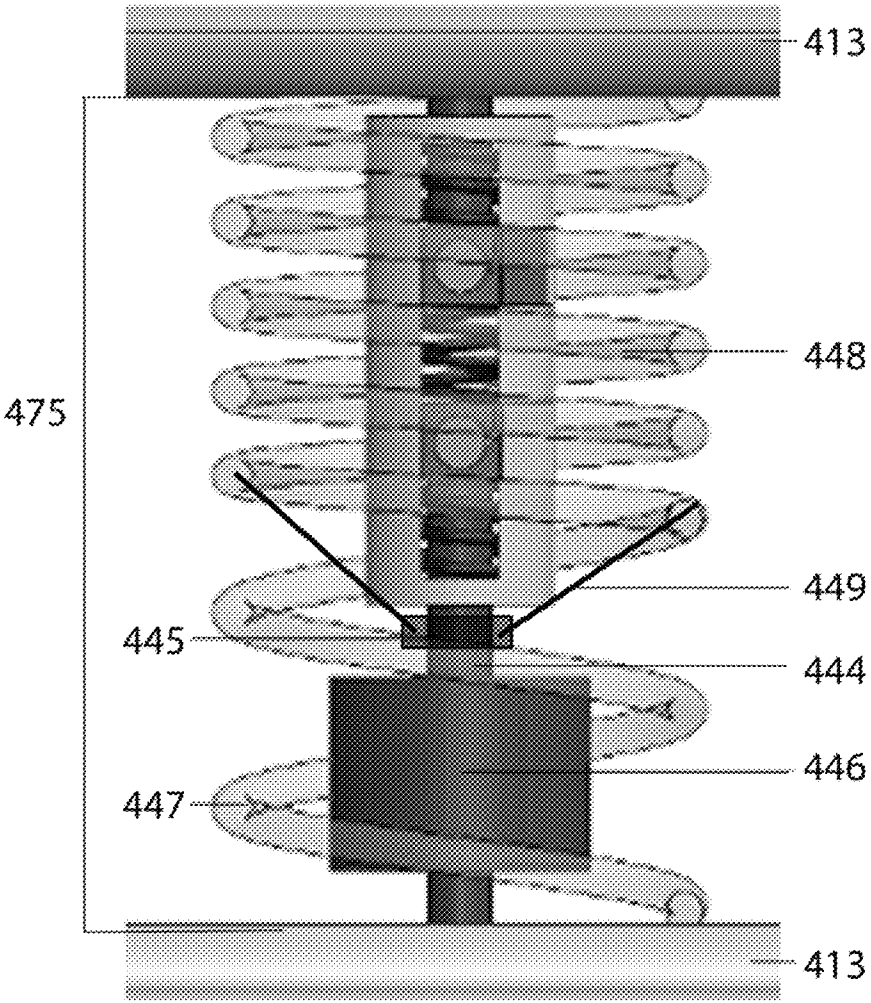
FIG. 13B is a detail view of a hospital bed in accordance to another embodiment of the present invention in which the pressure relief assembly is enlarged to show greater detail in which the outer springs are shown.
Figure 13A:
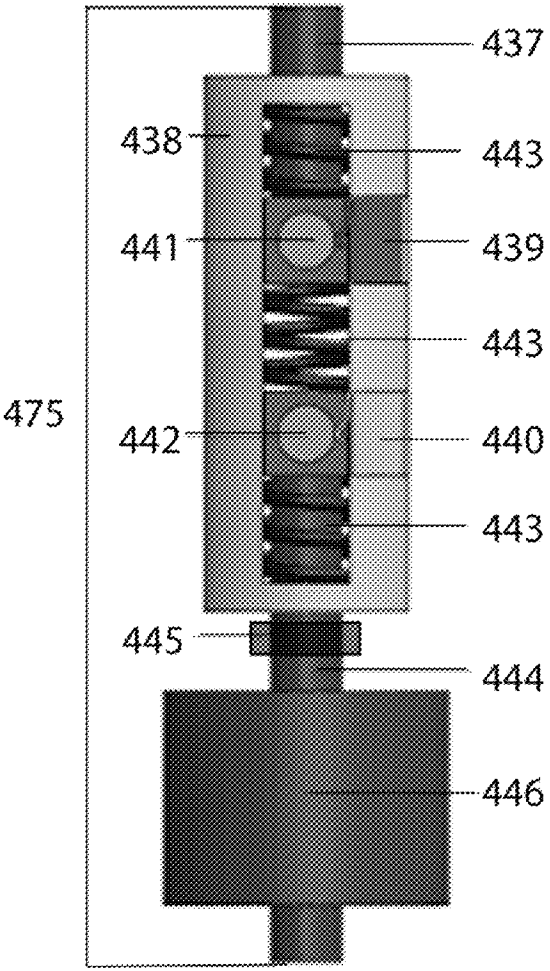
FIG. 13A is a detail view of a hospital bed in accordance to another embodiment of the present invention in which the pressure relief assembly is enlarged to show greater detail.

FIG. 13A, is a detail view of a hospital bed in accordance to another embodiment of the present invention in which the pressure relief assembly is enlarged to show greater detail. The pressure relief assembly 475, located within the primary mattress 413 is comprised of flexible cylindrical housing 438 into which a pressure relief rod 437 is inserted. One side of the pressure relief rod 437 protrudes out of the top of the flexible cylindrical housing 438 while the other end is connected to a sliding top magnet switch 441 after passing through small interior spring 443. A sliding bottom magnetic switch 442, is affixed to sides of the flexible cylindrical housing 438, which is located below the sliding top magnetic switch 441, separated by another small interior spring 443. The sliding bottom magnetic switch 442 is connected to a threaded pressure rod 437 that passes down through the bottom of the flexible cylindrical housing 438 after passing through another small interior spring 443. At the base of the threaded rod 444 there is a threaded collet 445 that connects it it to a pressure relief motor 446. A top fixed magnet 439, and a bottom fixed magnet 440, are affixed to the top of the threaded pressure rod 444, aligned with the sliding top magnetic switch 441, and the sliding bottom magnetic switch 442 respectively.

FIG. 13B, is a detail view of a hospital bed 401 in accordance to another embodiment of the present invention in which the pressure relief assembly 475 is enlarged to show greater detail. A light mattress spring 448, a heavy mattress spring 447 are shown encircling the pressure relief assembly 475. A tension cable 449 is also shown connecting the top rings of the heave mattress spring 447 to the threaded collet 445.

Figure 14A:
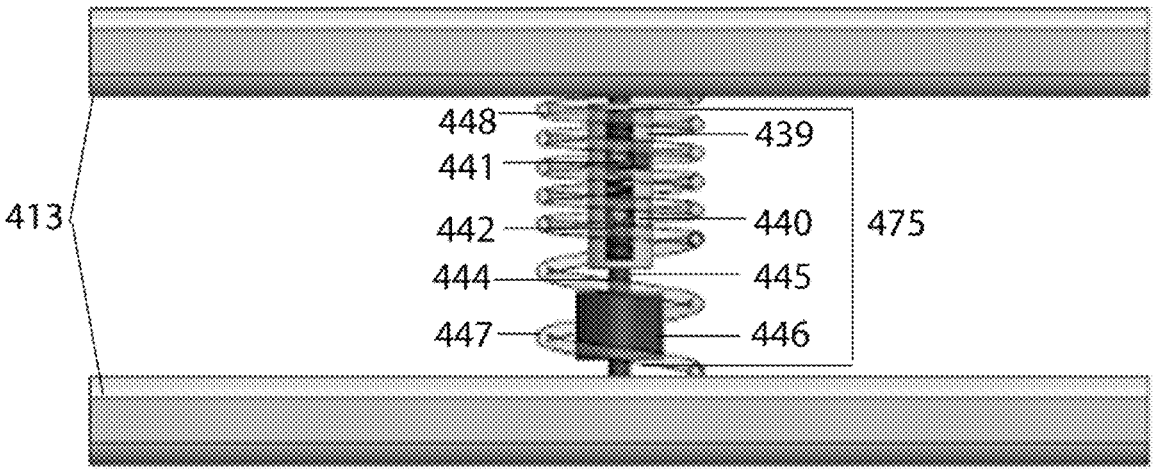
FIG. 14A is a front view of hospital bed in accordance to another embodiment of the present invention in which the pressure relief assembly is shown within the primary mattress when the primary mattress is in its default position.

FIG. 14A, is a front view of hospital bed 401 in accordance to another embodiment of the present invention in which the pressure relief assembly is shown within the primary mattress 413 when the primary mattress 413 is in its uncompressed default position. In this position the sliding top magnetic switch 441 and sliding bottom magnetic switch 442 are aligned with the top fixed magnet 439 and a bottom fixed magnet 440 respectively, causing the circuits to close and causing both switches to remain activated.

Figure 14B:
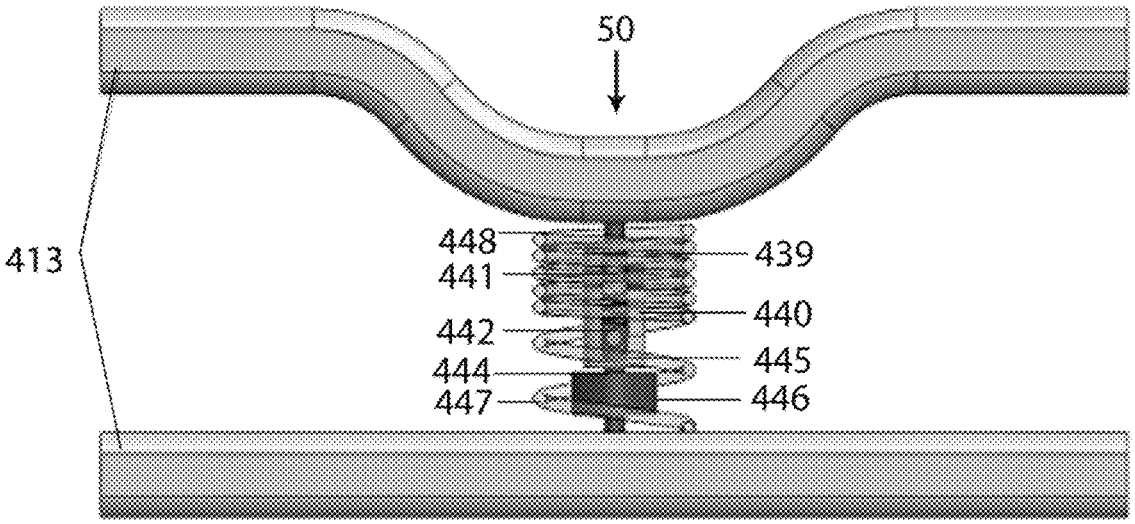
FIG. 14B is a front view of hospital bed in accordance to another embodiment of the present invention in which the pressure relief assembly is shown within the primary mattress after pressure has been applied to the top of the primary mattress.

FIG. 14B, is a front view of hospital bed 401 in accordance to another embodiment of the present invention in which the pressure relief assembly 475 is shown within the primary mattress 413 after pressure has been applied to the top of the primary mattress 413. When the primary mattress 413 is compressed from above, it pushes down on the light mattress spring along with pressure relief rod 437 which runs through the flexible cylindrical housing 438, pushing down the small interior springs 443 and the sliding top magnetic switch 441, thus breaking the circuit with the top fixed magnet 439. If the pressure being applied to the top of the primary mattress 413 is removed, the light mattress spring 448 and small interior springs 443 will unwind, pushing the primary mattress 413, the pressure relief rod 437 back to their default position and reactivating the sliding top magnet switch 441. However, if further pressure is applied to the already compressed pressure relief assembly 475, the pressure relief motor 446 will begin turning the threaded pressure rod 444, causing the threaded collet 445 to retract, pulling the tension cable 449 down. This movement will cause the heavy mattress spring 447 to retract along with the flexible cylindrical frame, causing the bottom magnet to no longer align with the bottom magnet switch, breaking the electrical circuit and keeping the pressure relief assembly 475 in a compressed position until the pressure from above is removed. When pressure is removed from above the small interior springs 443 and the light mattress springs 448 begin pushing the pressure relief assembly 475 and the top of the primary mattress back into the default uncompressed position. With the sliding top magnetic switch 441 and the top fixed magnet 439 now realigned, the motor will be activated and begin turning the threaded pressure rod 444 in the opposite direction, pushing up the threaded collet 445, loosening the tension cable 449 and allowing the heavy mattress spring 447 to fully decompress. In this way, the pressure relief assembly will be able to automatically sense and relieve pressure being applied by the patient as well that of the carriage assembly to help retract the primary mattress 413 to assist in the bed sheet changing process.

Figure 15:
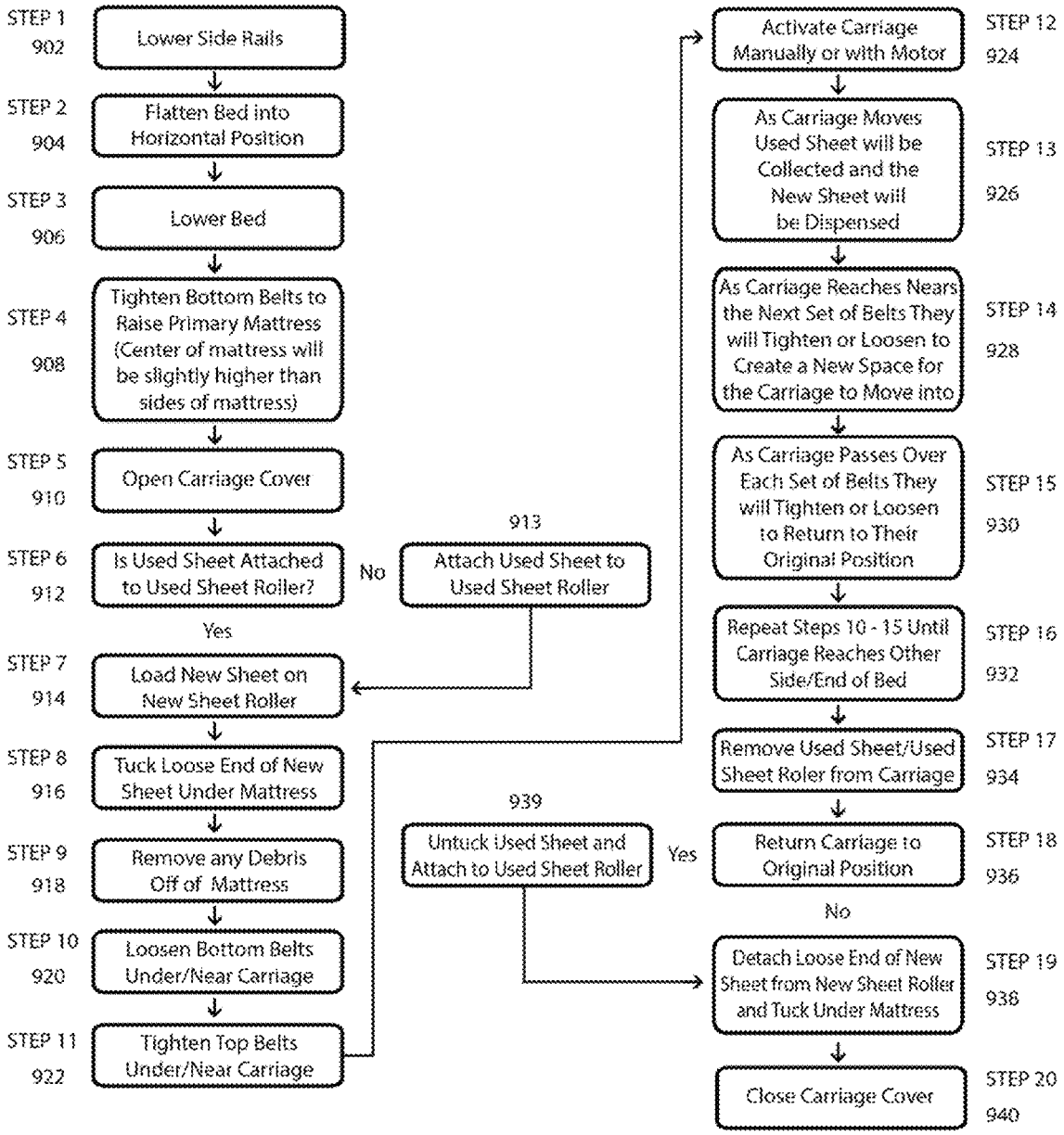
FIG. 15 is a block diagram explaining the sequence of operation for the entire bed including, but not limited to its ability to enable the bed frame assembly, carriage assembly and tension pulley assembly to function together in such a way as to facilitate the uninhibited movement of the carriage assembly across the bed to collect used bed sheets and dispense new bed sheets.

FIG. 15 is a block diagram explaining the sequence of operation for the entire bed, including, but not limited to its ability to enable the bed frame assembly, carriage assembly, and tension pulley assembly, to function together in such a way as to facilitate the uninhibited movement of the carriage assembly across the bed to collect used bed sheets, and dispense new bed sheets. In step 1, 902, one would lower side rails, and then in step 2, 904, one would flatten the bed into a horizontal position. In step 3, 906, the bed would be lowered, and in step 4, 908, one would tighten the bottom belts to raise primary mattress during this process the center of the mattress will be slightly higher than the sides of the mattress. In step 5, 910, one would open the carriage cover 265. In step 913, one would attach the used bed sheet onto the used bed sheet roller, and then in step 7, 914, one would load the new bed sheet onto the new bed sheet roller. In step 8, 916, one would tuck the loose end of the new bed sheet under the mattress. In step 9, 918, one would remove any debris off the mattress. In step 10, 920, one would loosen bottom belts under and the near the carriage. In step 11, 922, one would tighten top belts under or near the carriage. In step 12, 922, one would activate the carriage manually or using a motor. In step 13, 926, as the carriage moves the used bed sheets, and they will be collected and the new sheets will be dispensed onto the mattress. In step 14, 928, as the carriage moves and reaches near the next set of belts one would then tighten or loosen the belts to create new space or pocket for the carriage to move into. In step 15, 930, as the carriage passes over each set of belts one would tighten or loosen the belts to return them to their original position. In step 16, 932, one would repeat step 10, 920, to step 15, 930, until the carriage reaches the other side or end of the bed. In step 17, 934, one would remove the used bed sheets from the used bed sheet roller from the carriage. In step 18, 936, one would return the carriage to the original position. In step 19, 938, one would detach the loose end of the new bed sheet from the new sheet roller and tuck it under the mattress. In step 939, one would untuck the used bed sheet from the used bed sheet roller and attach the used bed sheet roller back into the carriage. In step 20, 940, one would close the carriage cover 265.

A carriage assembly is used in conjunction with the tension arc assembly and/or pressure roller assembly to create space in which to move vertically and/or horizontally across the top of primary mattress in order to dispense and collect new and used bed sheets without disturbing the patient occupying the bed space and to apply pressure to mattress allowing said carriage assembly to move freely across the bed. Although the patient is not shown, it is understood that the space or pocket created by the carriage assembly in conjunction with the tension arc assembly, and/or pressure relief assembly, will enable the uninhibited movement of the carriage assembly under the patient to complete the bed sheet changing process as shown in the FIGS., and more specifically in FIGS. 6, 7, 10, 11, and 12.

A pressure roller assembly is used in conjunction with the carriage assembly for maneuvering a series of pressure rollers to deform the primary mattress and the secondary mattress frame in order to create a space or pocket into which the carriage assembly can pass freely over the primary mattress in order to complete the bed sheet changing process. Although the patient is not shown, it is understood that the space or pocket created by the maneuvering of the pressure roller assembly will enable the uninhibited movement of the carriage assembly under the patient to complete the bed sheet changing process as shown in the FIGS., and more specifically in FIGS. 7, 10A-10B, and 11.

A tension arc assembly is used for deforming the primary mattress and the secondary mattress frame in order to creating space into which the carriage assembly can pass freely over in order to complete the bed sheet changing process, and/or to relieve pressure from the patient's neck, shoulder, buttocks and foot areas, so as to reduce the likelihood of bedsores, and/or other similar pressure related conditions, and/or to facilitate patient healing. Although the patient is not shown, it is understood that the space or pocket created by the maneuvering of the tension arc assembly will remove pressure from underneath specific areas of the patient as shown in the FIGS., and as more specifically shown in FIGS. 1, 3A-3B, 4, and 5.

A pressure relief assembly for automatically sensing the pressure areas of the patient and thereafter sending wireless commands to the tension arc assembly in order to deform the primary mattress in order to relieve pressure from the patient's neck, shoulder, buttocks, and foot areas, and to reduce the likelihood of bedsores, and/or other similar pressure related conditions, and/or to facilitate patient healing. Although the patient is not shown, it is understood that the space or pocket created by the maneuvering of the tension arc assembly as per the input received by the pressure controller assembly will remove pressure from underneath specific areas of the patient as shown in the FIGS., and more specifically shown in FIGS. 14A, 14B.

A pressure controller assembly has the ability or means to automatically sense the pressure areas of the patient and thereafter send wired or wireless commands to the tension arc assembly in order to deform the primary mattress so as to relieve pressure from the patient's neck, shoulder, buttocks, and foot areas, and to reduce the likelihood of bedsores, and/or other similar pressure related conditions, and/or to facilitate patient healing. Although the patient is not shown, it is understood that the space or pocket created by the maneuvering of the tension are assembly as per the input received by the pressure controller assembly will remove pressure from underneath specific areas of the patient as shown in the FIGS., and as more specifically shown in FIGS. 1, 3A-3B, 4, and 5.

A hospital bed for seamlessly changing bed sheets while occupied by a patient, comprises:

(a) a pressure controller assembly for automatically sensing the pressure areas of the patient and thereafter sending wireless commands to the tension arc assembly in order to deform the primary mattress to relieve pressure from the patient's neck, shoulder, buttocks and foot areas to reduce the likelihood of bedsores and/or other similar pressure related conditions and to facilitate patient healing, wherein said pressure controller assembly comprises;

(b) a means in said pressure controller assembly for automatically sensing various pressure area made by a patient's body and transmitting this information to the pressure controller.

(c) a means in said pressure controller assembly for analyzing information from the pressure mat regarding the various pressure areas made by a patient's body, and determining which pressure areas need to be relieved before transmitting this information to the wireless controller;

(d) a means in said pressure controller assembly for transmitting wireless commands to the tension arc assembly to reposition itself to relieve pressure from specific pressure areas of the patient as gathered by the pressure mat; and (e) a means in said pressure controller assembly for holding the pressure controller and wireless controller and allowing it to be moved easily.

A hospital bed for seamlessly changing bed sheets while occupied by a patient, comprising:

(a) a tension are assembly for deforming the primary mattress and secondary mattress frame in order to relieve pressure from the patient and/or creating space into which the carriage assembly to pass freely over it to complete the bed sheet changing process and to relieve pressure from the patient's neck, shoulder, buttocks and foot areas to reduce the likelihood of bedsores and/or other similar pressure related conditions and to facilitate patient healing, wherein said tension arc assembly comprises;

(b) a means in said tension arc assembly for holding the tension arc in place and allowing it to pivot right and left;

(c) a means in said tension arc assembly for working in conjunction with the top belts and support rollers to deform and support the mattress;

(d) a means in said tension arc assembly for connecting the tension arc on either sides of the bed;

(e) a means in said tension arc assembly for supporting the primary mattress and patient thereon;

(f) a means in said tension arc assembly for turning a threaded rod in order to push or pull it forwards and backwards to change its direction;

(g) a means in said tension arc assembly for supporting and applying upward pressure to the secondary mattress frame in order to deform it along with the primary mattress;

(h) a means in said tension arc assembly for connecting the arc motor to the threaded are rod;

(i) a means in said tension arc assembly for pushing or pulling threaded motor collet of the tension arc assembly to move the tension arc forwards and backwards to change its direction;

(j) a means in said tension arc assembly for apply tension to pull both sides of the tension arc together and to provide additional support and comfort to the patient;

(k) a means in said tension arc assembly for moving the tension arc forwards and backwards to change its direction;

(l) a means in said tension arc assembly for connecting the motor mounting frame to the master bed frame and allowing the motor mounting frame to rotate forwards or backwards as the tension arc changes direction;

(m) a means in said tension arc assembly for holding the arc motor;

(n) a means in said tension arc assembly for connecting the tension arc to the threaded motor collet and allowing the threaded motor collet to rotate forwards or backwards as the tension are changes direction;

(o) a means in said tension arc assembly for regulating the speed at which each side the tension arc can pivot;

(p) a means in said tension arc assembly for rolling under secondary mattress frame when upward pressure is being applied by the arc roller shaft.

(q) a means in said tension arc assembly for holding the arc pressure roller and allowing it to freely rotate under the secondary mattress frame.

(r) a means in said tension are assembly for pulling down and deforming the mattress to relieve pressure when each side of the tension arc pivots; and A hospital bed for seamlessly changing bed sheets while occupied by a patient, comprises:

(a) a bed frame assembly for providing physical support to patient, facilitate patient healing and work in conjunction with the carriage assembly and tension arc assembly to seamlessly change bed sheets while occupied by a patient, wherein said bed frame assembly comprises;

(a) a means in said bed frame assembly for holding a headboard, side rails and a footboard together, support the secondary mattress frame and can utilize horizontal and/or vertical support beams.

(b) a means in said bed frame assembly for containing the CPU, sensors, power supply and any other necessary parts to make the hospital bed function; and (c) a means in said bed frame assembly for allowing the patient and/or caregiver to control the movement of various parts of the bed and to relieve pressure from specific areas thereof.

(d) a means in said bed frame assembly for supporting and protecting the patient from falling out of bed will be attached to the master bed frame.

(e) a means in said bed frame assembly for adding structural stability to the master bed frame.

(f) a means in said bed frame assembly for allowing the carriage assembly to slide along the sides of the bed.

A hospital bed for seamlessly changing bed sheets while occupied by a patient, comprising:

(a) a carriage assembly for moving vertically and/or horizontally across the top of the hospital bed in order to dispense and collect new and used bed sheets without disturbing the patient occupying the bed space and to apply pressure to mattress allowing said carriage assembly to move freely across the bed, wherein said carriage assembly comprises:

(b) a means in said carriage assembly for collecting the used bed sheets consisting of a removable rod that will rotate either counter clock-wise (ccw) or clock-wise (cw) depending on the motion of said carriage assembly;

(c) a means in said carriage assembly for dispensing the new bed sheet consisting of a removable rod that will rotate either counter clock-wise (ccw) or clock-wise (cw) depending on the motion of the carriage assembly;

(d) a means in said carriage assembly for applying downward pressure on top mattress and primary mattress to create clearance for the carriage assembly to freely move across the bed. Works in conjunction with the top belts;

(e) a means in said carriage assembly for providing the master rack gear with a means of moving the carriage assembly linearly along the bed frame. The carriage assembly contains a circular rack gear that rests on rack and enables the carriage to travel along the rack as the circular gear rotates, turning rotational motion into linear action;

(f) a means in said carriage assembly for holding the mounting plates on either end of the carriage assembly together;

(g) a means in said carriage assembly for rotating the used bed sheet roller when the master rack gear rotates, connected to said means for rolling up the used bed sheet;

(h) a means in said carriage assembly for rotating the new bed sheet roller when the master rack gear rotates, connected to said means for rolling up the new bed sheet;

(i) a means in said carriage assembly for guiding the carriage along to the gear rack via a threaded hole that interacts with threaded rod to reduce slippage, connected to said means for holding the headboard and the footboard together;

(j) a means in said carriage assembly for slipping and thereby preventing said roller from rotating when anything obstructs the rolling process dispensing and collecting the two said bed sheets, in order to protect the patient and bed components from being injured/damaged, connected to said means for rotating the new bed sheet roller when the master rack gear rotates, connected to said means for rotating the used bed sheet roller when the master rack gear rotates;

(k) a means in said carriage assembly for allowing the rotation of the various rollers, gears and pulleys used throughout the hospital bed;

(l) a means in said carriage assembly for engaging the gear rack in order to move the carriage assembly along the bed;

(m) a means in said carriage assembly for rotating the center belt in order to turn the master rack gear;

(n) a means in said carriage assembly for rotating the master gear when the center belt gear rotates;

(o) a means in said carriage assembly for rotating the threaded rod to move the carriage assembly across the bed;

(p) a means in said carriage assembly for holding both sides of carriage assembly together as well as preventing the patient from touching the rotating bed sheet rollers;

(q) a means in said carriage assembly for moving the carriage assembly along gear rack, connected to said means for rotating the threaded rod to move the carriage assembly across the bed;

(r) a means in said carriage assembly for holding all the different parts of the carriage assembly together;

(s) a means in said carriage assembly for providing additional comfort and protection for the patient, placed between top belts and patient body; and (t) a means in said carriage assembly for guiding the carriage along the threaded rod parallel to the gear rack, threadably inserted to said means for moving the carriage assembly along gear rack, and structurally embedded to said means for guiding the carriage along to the gear rack via a threaded hole that interacts with threaded rod to reduce slippage.

A hospital bed for seamlessly changing bed sheets while occupied by a patient, comprising:

(a) a programmable logic controller and/or microprocessor for determining the sequence of operation for the entire bed including, but not limited to its ability to enable the bed frame assembly, carriage assembly and tension arc assembly to function together in such a way as to facilitate the uninhibited movement of the carriage assembly across the bed to collect used bed sheets and dispense new bed sheets. This is accomplished by elevating a section of the primary mattress via the tension arc assembly, while simultaneously lowering another section thereof, creating an empty space large enough to allow the carriage assembly to pass freely over the primary mattress from one end of the bed to another without tension.

A hospital bed for seamlessly changing bed sheets while occupied by a patient, comprises:

(a) a pressure relief assembly for automatically sensing and relieving pressure areas of the patient generally and specifically from beneath the shoulder, buttocks and foot areas to reduce the likelihood of bedsores and/or other similar pressure related conditions and to facilitate patient healing, as well as to help retract the primary mattress to assist with the bed changing process, wherein said pressure relief assembly comprises;

(b) a means in said pressure relief assembly for pushing down the top magnetic switch;

(c) a means in said pressure relief assembly for pushing various parts of parts of the pressure relief assembly back into its default position and preventing them from damaging each other;

(d) a means in said pressure relief assembly for interacting with the top magnet to activate or deactivate and electrical circuit;

(e) a means in said pressure relief assembly for interacting with the top magnetic switch to activate or deactivate and electrical circuit;

(f) a means in said pressure relief assembly for interacting with the bottom magnet to activate or deactivate and electrical circuit;

(g) a means in said pressure relief assembly for interacting with the bottom magnetic switch to activate or deactivate and electrical circuit, (h) a means in said pressure relief assembly for forming the flexible outer casing of the pressure relief assembly;

(i) a means in said pressure relief assembly for moving the threaded collet up and down;

(j) a means in said pressure relief assembly for turning the threaded pressure rod;

(k) a means in said pressure relief assembly for pulling the heavy mattress spring down;

(l) a means in said pressure relief assembly for easily compressing under the weight applied on top of the primary mattress by the patient and/or the carriage assembly to relieve pressure; and (h) a means in said pressure relief assembly for further compressing under the weight applied on top of the primary mattress by the patient and/or the carriage assembly relieve more pressure.

A hospital bed for seamlessly changing bed sheets while occupied by a patient, comprising:

(a) a tension arc assembly for deforming the primary mattress and secondary mattress frame in order to relieve pressure from the patient's neck, shoulder, buttocks and foot areas to reduce the likelihood of bedsores and/or other similar pressure related conditions and to facilitate patient healing, wherein said tension arc assembly comprises;

(b) a means in said tension arc assembly for holding the tension arc in place and allowing it to pivot right and left;

(c) a means in said tension arc assembly for holding the arc pivoting pins and for readjusted the location of the tension arc assembly along the master bed frame;

(d) a means in said tension arc assembly for connecting the tension arc on either sides of the bed and allowing them to pivot uniformly;

(e) a means in said tension arc assembly for turning a threaded rod in order to push or pull the tension arc forwards and backwards;

(f) a means in said tension arc assembly for connecting the arc motor to the threaded arc rod;

(g) a means in said tension arc assembly for pushing or pulling threaded motor collet of the tension arc assembly to move the tension arc forwards and backwards to change its direction;

(h) a means in said tension arc assembly for moving the tension arc forwards and backwards to change its direction;

(i) a means in said tension arc assembly for connecting the motor mounting frame to the master bed frame and allowing the motor mounting frame to rotate forwards or backwards as the tension arc changes direction;

(j) a means in said tension arc assembly for holding the arc motor;

(k) a means in said tension arc assembly for connecting the tension arc to the threaded motor collet and allowing the threaded motor collet to rotate forwards or backwards as the tension arc changes direction;

(l) a means in said tension arc assembly for pulling down and deforming the mattress to relieve pressure when each side of the tension arc pivots.

(m) a means in said tension arc assembly for turning a threaded adjustment rod electronically to adjust the location of mounting bracket along the master bed frame:

(n) a means in said tension arc assembly for turning a threaded adjustment rod manually to adjust the location of mounting bracket along the master bed frame; and (o) a means in said tension arc assembly for interacting with the threaded adjustment rod to adjust the location of mounting bracket along the master bed frame.

A hospital bed for seamlessly changing bed sheets while occupied by a patient, comprises:

(a) a pressure roller assembly for providing physical support to patient and work in conjunction with the carriage assembly to deform mattress to seamlessly change bed sheets while occupied by a patient, wherein said pressure roller assembly comprises;

(a) a means in said pressure roller assembly for supporting the primary mattress and patient thereon;

(b) a means in said pressure roller assembly for rolling under and supporting the secondary mattress frame and holding the protruding bearings;

(c) a means in said pressure roller assembly for allowing the pressure rollers to freely rotate under the secondary mattress frame and interacting with the channeled roller plate to pull down the pressure rollers to deform the secondary mattress frame and the primary mattress to assist in the bed sheet changing process of the carriage assembly; and (d) a means in said pressure roller assembly for connecting to the carriage assembly and interacting with the protruding bearings to pull down the pressure rollers to deform the secondary mattress frame and the primary mattress to assist in the bed sheet changing process of the carriage assembly, and sliding along the sliding carriage frame.

A hospital bed for seamlessly changing bed sheets while occupied by a patient, comprising:

(a) a carriage assembly for moving across the top of the hospital bed in order to dispense and collect new and used bed sheets without disturbing the patient occupying the bed space and to apply pressure to mattress allowing said carriage assembly to move freely across the bed, wherein said carriage assembly comprises;

(b) a means in said carriage assembly for collecting the used bed sheets consisting of a removable rod that will rotate either counter clock-wise (ccw) or clock-wise (cw) depending on the motion of said carriage assembly;

(c) a means in said carriage assembly for dispensing the new bed sheet consisting of a removable rod that will rotate either counter clock-wise (ccw) or clock-wise (cw) depending on the motion of the carriage assembly;

(d) a means in said carriage assembly for applying downward pressure on top mattress and primary mattress to create clearance for the carriage assembly to freely move across the bed. Works in conjunction with the top belts;

(e) a means in said carriage assembly for providing the master rack gear with a means of moving the carriage assembly linearly along the bed frame. The carriage assembly contains a circular rack gear that rests on rack and enables the carriage to travel along the rack as the circular gear rotates, turning rotational motion into linear action;

(f) a means in said carriage assembly for holding the mounting plates on either end of the carriage assembly together;

(g) a means in said carriage assembly for rotating the used bed sheet roller when the master rack gear rotates, connected to said means for rolling up the used bed sheet;

(h) a means in said carriage assembly for rotating the new bed sheet roller when the master rack gear rotates, connected to said means for rolling up the new bed sheet;

(i) a means in said carriage assembly for guiding the carriage along to the gear rack via a threaded hole that interacts with threaded rod to reduce slippage, connected to said means for holding the headboard and the footboard together;

(j) a means in said carriage assembly for slipping and thereby preventing said roller from rotating when anything obstructs the rolling process dispensing and collecting the two said bed sheets, in order to protect the patient and bed components from being injured/damaged, connected to said means for rotating the new bed sheet roller when the master rack gear rotates, connected to said means for rotating the used bed sheet roller when the master rack gear rotates;

(k) a means in said carriage assembly for allowing the rotation of the various rollers, gears and pulleys used throughout the hospital bed;

(l) a means in said carriage assembly for engaging the gear rack in order to move the carriage assembly along the bed;

(m) a means in said carriage assembly for rotating the center belt in order to turn the master rack gear;

(n) a means in said carriage assembly for rotating the master gear when the center belt gear rotates;

(o) a means in said carriage assembly for rotating the threaded rod to move the carriage assembly across the bed;

(p) a means in said carriage assembly for holding both sides of carriage assembly together as well as preventing the patient from touching the rotating bed sheet rollers;

(q) a means in said carriage assembly for moving the carriage assembly along gear rack, connected to said means for rotating the threaded rod to move the carriage assembly across the bed;

(r) a means in said carriage assembly for holding all the different parts of the carriage assembly together;

(s) a means in said carriage assembly for providing additional comfort and protection for the patient, placed between top belts and patient body; and (t) a means in said carriage assembly for guiding the carriage along the threaded rod parallel to the gear rack, threadably inserted to said means for moving the carriage assembly along gear rack, and structurally embedded to said means for guiding the carriage along to the gear rack via a threaded hole that interacts with threaded rod to reduce slippage.

A hospital bed for seamlessly changing bed sheets while occupied by a patient, comprising:

(a) a programmable logic controller and/or microprocessor for determining the sequence of operation for the entire bed including, but not limited to its ability to enable the pressure roller assembly, the pressure relief assembly and the carriage assembly to function together in such a way as to facilitate the uninhibited movement of the carriage assembly across the bed to collect used bed sheets and dispense new bed sheets. This is accomplished by using the pressure roller assembly, the pressure relief assembly and the carriage assembly to deform the mattress downwards to create an empty space large enough to allow the carriage assembly to pass freely over the primary mattress from one end of the bed to another without tension. Additionally, the tension arc assembly and pressure relief assembly are programmed to work in conjunction with one another to automatically sense and relieve pressure areas of the patient generally and specifically from beneath the shoulder, buttocks and foot areas to reduce the likelihood of bedsores and/or other similar pressure related conditions and to facilitate patient healing.

Thus, the present invention is not limited to the embodiments described herein the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A bed, comprising:

a mattress;

a carriage assembly comprising a carriage motor coupled to a gear assembly, wherein the motor and gear assembly are configured to move the carriage assembly across the mattress, and wherein the carriage assembly further comprises first and second sheet rollers coupled to the gear assembly, wherein the first sheet roller is configured to collect a used bed sheet from the mattress and the second sheet roller is configured to dispense a new bed sheet onto the mattress as the carriage assembly moves across the mattress from a first position to a second position; and at least two adjacent means for exerting downward pressure sequentially along at least first and second lengths of the mattress, thereby creating at least first and second lengthwise pockets in the mattress into which at least a portion of the carriage assembly resides as it moves from its first position to its second position.

2. The bed of claim 1, wherein the adjacent means comprise adjacent tension arcs configured to pivot.

3. The bed of claim 2, wherein each tension arc comprises associated left and right arc sides.

4. The bed of claim 3, wherein each of the left and right arc sides comprises a belt and a pressure roller, wherein the belts are positioned over portions of the mattress along substantially parallel lengths, and wherein the pressure rollers are positioned under portions of the mattress along the substantially parallel lengths.

5. The bed of claim 4, wherein pivoting of one of the tension arcs causes one of the associated arc sides to move upward and the other associated arc side to move downward, thereby simultaneously raising and lowering portions of the mattress along the substantially parallel lengths.

6. The bed of claim 1, wherein the adjacent means comprise adjacent pressure rollers positioned under portions of the mattress along substantially parallel lengths and associated roller belts positioned over portions of the mattress along the substantially parallel lengths.

7. The bed of claim 6, further comprising a channeled roller plate coupled to the carriage assembly.

8. The bed of claim 1, further comprising a pressure mat, configured to detect pressure areas exerted by a patient's body, wherein the pressure mat is in communication with a pressure controller.

9. The bed of claim 8, wherein the pressure controller is in communication with the adjacent means for exerting downward pressure, wherein the pressure controller is configured to determine which pressure areas are in need of relief, such that when the pressure controller determines that a pressure area is in need of relief, one or more of the adjacent means are actuated to exert downward pressure on the mattress, thereby relieving pressure to the pressure area.

10. The bed of claim 8, further comprising a wireless controller.

11. The bed of claim 1, further comprising one or more pressure relief assemblies positioned within the mattress.

12. The bed of claim 11, wherein the pressure relief assemblies are configured to automatically sense pressure and send a wireless signal to the adjacent means for exerting downward pressure.

* * * * *